US005720155A

United States Patent [19]

Weder

[11] Patent Number: 5,720,155

[45] Date of Patent: Feb. 24, 1998

[54] METHOD OF WRAPPING A FLORAL PRODUCT WITH A SHEET OF MATERIAL HAVING A THREE DIMENSIONAL PATTERN PRINTED THEREON

[75] Inventor: Donald E. Weder, Highland, Ill.

[73] Assignee: Southpac Trust International, Inc.

[21] Appl. No.: 821,014

[22] Filed: Mar. 19, 1997

Related U.S. Application Data

[63] Continuation of Ser. No. 477,003, Jun. 7, 1995, Pat. No. 5,661,951.

[51] Int. Cl.[6] ..... B65B 11/00

[52] U.S. Cl. ..... 53/397; 53/399; 53/411; 53/461; 53/465

[58] Field of Search ..... 47/72; 53/411, 53/131.2, 131.4, 131.5, 397, 399, 443, 461, 465, 466; 206/423, 459.5; 29/922, 923, 87.01, 87.19

[56] References Cited

U.S. PATENT DOCUMENTS

| | | |
|---|---|---|
| 557,526 | 3/1896 | Egge . |
| 732,889 | 7/1903 | Paver . |
| 1,525,015 | 2/1925 | Weeks . |
| 1,863,216 | 6/1932 | Wordingham . |
| 1,978,631 | 10/1934 | Herrlinger . |
| 2,032,386 | 3/1936 | Wood . |
| 2,048,123 | 7/1936 | Howard . |
| 2,170,147 | 8/1939 | Lane . |
| 2,278,673 | 4/1942 | Savada et al. . |
| 2,371,985 | 3/1945 | Freiberg . |
| 2,411,328 | 11/1946 | MacNab . |
| 2,510,120 | 6/1950 | Leander . |
| 2,529,060 | 11/1950 | Trillich . |
| 2,544,075 | 3/1951 | Ernst et al. . |
| 2,621,142 | 12/1952 | Wetherell . |
| 2,822,287 | 2/1958 | Avery . |
| 2,846,060 | 8/1958 | Yount . |
| 2,883,262 | 4/1959 | Borin . |
| 3,022,605 | 2/1962 | Reynolds . |
| 3,027,263 | 3/1962 | Wanamaker . |
| 3,113,712 | 12/1963 | Kindseth . |
| 3,121,647 | 2/1964 | Harris et al. . |
| 3,130,113 | 4/1964 | Silman . |
| 3,148,799 | 9/1964 | Meroney . |
| 3,215,330 | 11/1965 | Thomas . |
| 3,271,922 | 9/1966 | Wallerstein et al. . |
| 3,508,372 | 4/1970 | Wallerstein et al. . |
| 3,514,012 | 5/1970 | Martin . |
| 3,620,366 | 11/1971 | Parkinson et al. . |
| 3,681,105 | 8/1972 | Milutin et al. . |
| 3,757,990 | 9/1973 | Buth . |
| 3,808,024 | 4/1974 | Witman . |
| 3,927,821 | 12/1975 | Dunning . |
| 3,950,290 | 4/1976 | Drury, Jr, et al. . |
| 3,951,892 | 4/1976 | Drury, Jr. et al. . |
| 4,054,697 | 10/1977 | Reed et al. . |
| 4,055,613 | 10/1977 | Kapral . |
| 4,068,030 | 1/1978 | Witman . |
| 4,216,620 | 8/1980 | Weder et al. . |

(List continued on next page.)

FOREIGN PATENT DOCUMENTS

| | | |
|---|---|---|
| 0142867 | 5/1985 | European Pat. Off. . |
| 55-75466 | 6/1980 | Japan . |
| 2215672 | 9/1987 | Japan . |
| 9003412 | 4/1990 | WIPO . |

OTHER PUBLICATIONS

Speed Cover Brochure, "The Simple Solution For Those Peak Volume Periods" Highland Supply Corp. ©1989.

Speed Sheets & Speed Rolls Brochure, Highland Supply Corporation, ©1990.

*Primary Examiner*—Daniel Moon

*Attorney, Agent, or Firm*—Dunlap & Codding, P.C.

[57] ABSTRACT

A method of forming a decorative cover, a sleeve or a preformed pot cover for a floral grouping or flower pot from a sheet of material having a three-dimensional printed pattern thereon wherein the three-dimensional pattern is produced by application of a foamable ink composition to the sheet of material.

74 Claims, 6 Drawing Sheets

U.S. PATENT DOCUMENTS 4,297,811 11/1981 Weder .
4,333,267 6/1982 Witte .
4,379,101 4/1983 Smith .
4,380,564 4/1983 Cancio et al. .
4,413,725 11/1983 Bruno et al. .
4,427,731 1/1984 Gibson .
4,471,079 9/1984 Enami .
4,500,373 2/1985 Kubota .
4,546,875 10/1985 Zweber .
4,690,843 9/1987 Inagaki .
4,695,503 9/1987 Liu et al. .
4,733,521 3/1988 Weder et al. .
4,765,464 8/1988 Ristvedt .
4,844,849 7/1989 Miller et al. .
4,960,638 10/1990 Mukoyoski et al. .
5,028,482 7/1991 Jeffs .
5,111,638 5/1992 Weder .
5,126,010 6/1992 Kobayaski et al. .
5,147,706 9/1992 Kingman .
5,181,364 1/1993 Weder .
5,186,988 2/1993 Dixon .
5,205,108 4/1993 Weder et al. .
5,228,234 7/1993 deKlerk et al. .
5,239,775 8/1993 Landau .
5,262,222 11/1993 Kingman .
5,281,261 1/1994 Lin .
5,288,160 2/1994 Li et al. .
5,307,605 5/1994 Straeter .
5,320,672 6/1994 Whalen-Shaw .
5,335,477 8/1994 Weder .
5,347,789 9/1994 Weder .
5,381,642 1/1995 Weder et al. .
5,388,695 2/1995 Gilbert .
5,443,670 8/1995 Landau .

METHOD OF WRAPPING A FLORAL PRODUCT WITH A SHEET OF MATERIAL HAVING A THREE DIMENSIONAL PATTERN PRINTED THEREON

CROSS-REFERENCE TO RELATED APPLICATIONS

This application is a continuation of U.S. Ser. No. 08/477,003, filed Jun. 7, 1995 entitled "METHOD OF WRAPPING A FLORAL PRODUCT WITH A SHEET OF MATERIAL HAVING A THREE DIMENSIONAL PATTERN PRINTED THEREON now U.S. Pat. No. 5,661,951.

FIELD OF THE INVENTION

The present invention relates to methods of wrapping floral groupings and flower pots with a sheet of material to provide a decorative cover for such floral groupings and flower pots, and more particularly but not by way of limitation to methods of wrapping floral groupings and flower pots with a sheet of material having a three dimensional pattern printed thereon.

DESCRIPTION

The present invention comprises methods of wrapping floral groupings, flower pots containing potted plants or other pot means with a sheet of material having a three dimensional pattern printed thereon to provide a decorative cover or sleeve for such floral groupings, flower pots containing potted plants or other pot means. The methods comprise providing a sheet of material having a three dimensional pattern printed thereon and wrapping the sheet of material about a floral grouping or a flower pot or other pot means to provide a decorative cover having a three dimensional printed pattern.

Description of FIGS. 1–9

Figure 1:
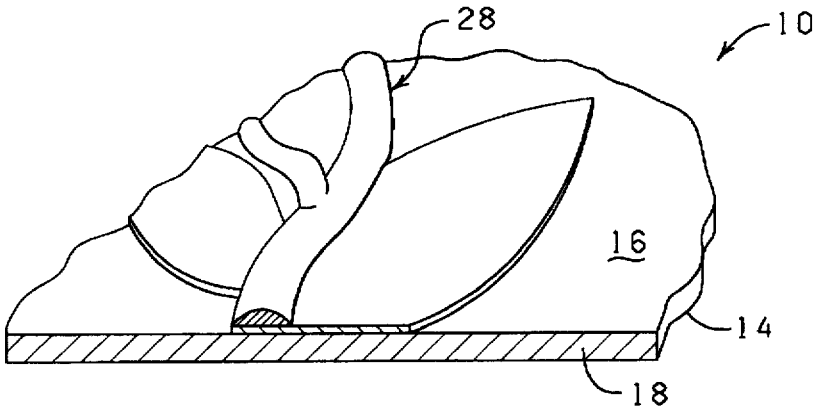
FIG. 1 is an enlarged, fragmental, perspective view of a sheet of material having a three dimensional pattern printed thereon for wrapping floral groupings and flower pots in accordance with the present invention.
Figure 2:
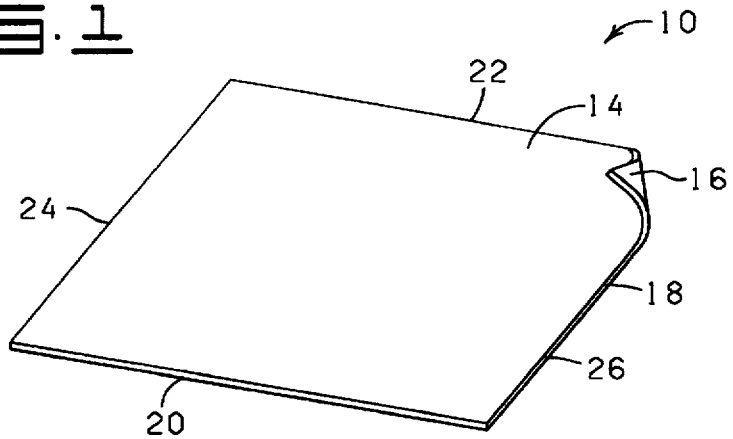
FIG. 2 is a perspective view of the sheet of material of FIG. 1 having a floral grouping disposed thereon.

Referring now to FIGS. 1 and 2, designated generally by the reference numeral 10 is a sheet of material having an upper surface 14, a lower surface 16, and an outer peripheral edge 18. As shown in FIG. 2, the outer peripheral edge 18 of the sheet of material 10 comprises a first side 20, a second side 22, a third side 24, and fourth side 26. A bonding material 27 (FIGS. 3 and 4) may be disposed on at least a portion of one or both surfaces of the sheet of material 10, such as the upper surface 34 thereof as shown and as further illustrated in U.S. Pat. No. 5,181,364, the specification of which is hereby expressly incorporated herein by reference.

The sheet of material 10 has a three dimensional pattern 28 printed on at least a portion of one of the upper or lower surfaces 14 and 16 thereof, such as the lower surface 16 as shown in FIGS. 1 and 3–6. The three dimensional pattern 28 may be of any geometrical shape or design which will enhance the aesthetic qualities of a decorative cover 29 (FIGS. 5 and 6) formed from the sheet of material 10. That is, the three dimensional pattern 28 may be a lace pattern, curlicues, paisleys, swirls, squiggles, and any shape generally associated with botanical items such as leaves, petals, stems, roots, fruits and any other biomorphic shapes. Further, the three dimensional pattern 28 which is produced by printing with a foamable ink may be of a single color or portions of the three dimensional pattern 28 may be printed with foamable inks of different colors so that a portion of the three dimensional pattern 28 is printed in at least a first color and other portions of the three dimensional pattern 28 are printed in at least a second color such that the three dimensional pattern 28 consists of multiple colors.

Figure 16:
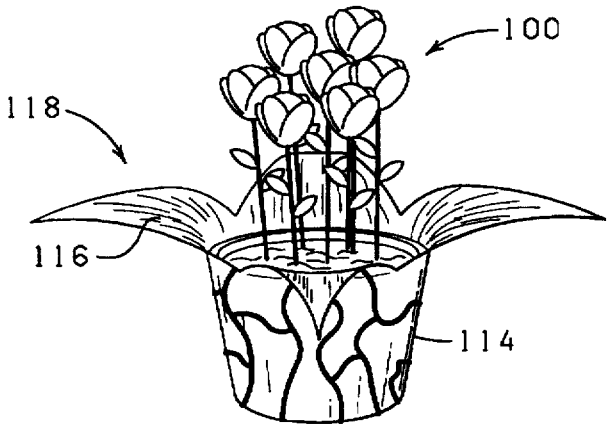
FIG. 16 is a perspective view of a flower pot disposed in the sleeve of FIG. 14 wherein an upper portion of the sleeve has been removed to provide a decorative cover having a skirt
Figure 17:
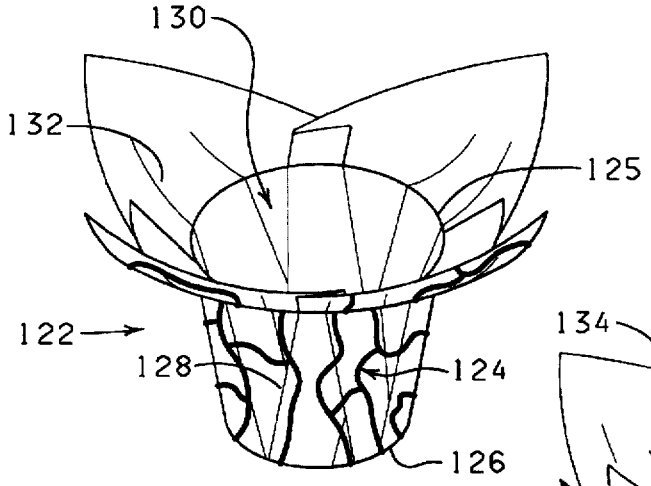
FIG. 17 is a perspective view of a preformed pot cover formed from a sheet of material having a three dimensional pattern printed thereon
Figure 18:
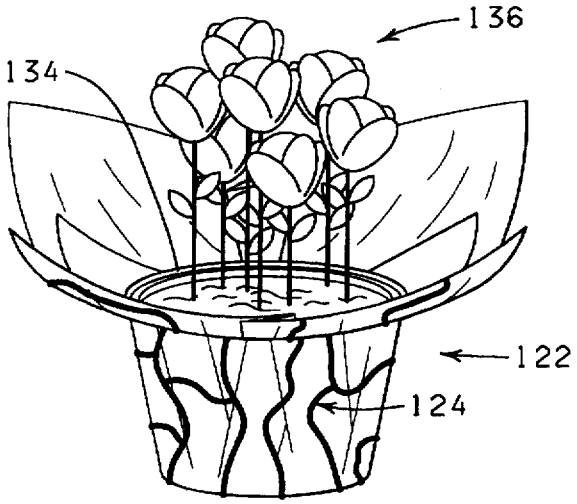
FIG. 18 is a perspective view of the preformed pot cover of FIG. 17 having a flower pot disposed therein.

The three dimensional pattern 28 may cover only a portion of the sheet of material 10 or may cover an entire surface of the sheet of material 10, or may cover all exposed and/or interior surfaces of the sheet of material 10. The sheet of material 10 having the three dimensional pattern 28 printed thereon may be employed to provide a decorative cover for a floral grouping (FIGS. 5 and 6) or a decorative cover for a flower pot (FIG. 8); or it may be employed to provide a sleeve for wrapping or covering a floral grouping (FIGS. 11 and 13) or a flower pot (FIGS. 15 and 16); or it may be employed to form a preformed flower pot cover for covering a flower pot (FIGS. 17 and 18). The use of the sheet of material 10 having the three dimensional pattern 28 printed thereon to form a decorative cover for a floral grouping or a flower pot, to form a sleeve for a floral grouping or a flower pot, or to form a preformed flower pot cover will be described in more complete detail herein.

As noted above, the sheet of material 10 having the three dimensional pattern 28 printed thereon, can be utilized to form a decorative cover for a floral grouping or a flower pot. The term "flower pot" as used herein refers to any type of container for holding a floral grouping, or a plant, or even another pot type container. Examples of flower pots and/or pot type containers include, but are not limited to, clay pots, wooden pots, plastic pots, pots made from natural mad/or synthetic fibers, or any combination thereof. Such flower pots and or pot-type containers are provided with a retaining space for receiving a floral grouping. The floral grouping may be disposed within the retaining space of the flower pot with a suitable growing medium described in further detail below, or other retaining medium, such as a floral foam. It will also be understood that in some cases the floral grouping, and any appropriate growing medium or other retaining medium, may be disposed in a sleeve formed from the sheet of material 10 having a three dimensional pattern printed thereon if the sleeve is adapted to contain a medium.

"Floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. Further, the floral grouping may comprise a growing potted plant having a root portion as well. However, it will be appreciated that the floral grouping may consist of only a single bloom or only foliage, or a botanical item (not shown), or a propagule. The term "floral grouping" may be used interchangeably herein with the term "floral arrangement". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In the embodiments shown in the drawings, the sheet of material 10 having the three dimensional pattern 28 printed thereon is square. It will be appreciated, however, that the sheet of material 12 having the three dimensional pattern 28 printed thereon can be of any shape, configuration or size as long as the sheet of material 10 is sufficiently sized and shaped to wrap and encompass a flower pot or a floral grouping. For example, the sheet of material 12 may have a rectangular, round, oval, octagonal or asymmetrical shape. Further, multiple sheets of material 10 may be used in a single circumstance to provide a decorative cover or sleeve for a flower pot or a floral grouping. Moreover, when multiple sheets of material 10 are used in combination, the sheets of material 10 need not be uniform in size or shape. Finally, it will be appreciated that the sheet of material 10 having a three dimensional printed pattern 28 shown in all embodiments herein is a substantially flat sheet except for the three dimensional pattern 28 printed thereon.

Any thickness or stiffness of the sheet of material 12 may be utilized in accordance with the present invention as long as the sheet of material 12 having the three dimensional pattern 28 printed thereon may be wrapped about at least a portion of a flower pot or a floral grouping, as described herein. Stiffer sheets may be scored to facilitate their folding. The sheet of material 10 preferably has a thickness of from about 0.1 mil to about 30 mils. Typically, the sheet of material 10 has a thickness in a range of about 0.5 mils to about 2.5 mils.

The sheet of material 10 is constructed from any suitable wrapping material that is capable of being wrapped about a flower pot or floral grouping. Preferably, the sheet of material 10 is paper (untreated or treated in any manner), cellophane, metal foil, polymer film, non-polymer film, fabric (woven or nonwoven or synthetic or natural), cardboard, burlap, or laminations or combinations thereof having the three dimensional pattern 28 printed thereon.

The term "polymer film" when used herein means a man-made polymer such as a polypropylene or a naturally occurring polymer such as cellophane. A polymer film is relatively strong and not as subject to tearing (substantially non-tearable), as might be the case with paper or foil.

The sheet of material 10 may also be constructed, in whole or in part, from a cling material. "Cling Wrap or Material" when used herein means any material which is capable of connecting to the sheet of material and/or itself upon contacting engagement during the wrapping process and is wrappable about an item whereby portions of the cling material contactingly engage and connect to other portions of another material, or, alternatively, itself, for generally securing the material wrapped about at least a portion of a flower pot. This connecting engagement is preferably temporary in that the material may be easily removed, i.e., the cling material "clings" to the flower pot.

The cling material is constructed and treated if necessary, from polyethylene such as Cling Wrap made by Glad®, First Brands Corporation, Danbury, Conn. The thickness of the cling material will, in part, depend upon the size of sleeve and the size of the flower pot in the sleeve, i.e., generally, a larger flower pot may require a thicker and therefore stronger cling material. The cling material will range in thickness from about 0.1 mils to about 10 mils, and preferably from about 0.5 mils to about 2.5 mils and most preferably from about 0.6 mils to about 2 mils. However, any thickness of cling material may be utilized in accordance with the present invention which permits the cling material to be printed with a foamable ink composition so as to provide the cling material with a three dimensional printed pattern which is capable of functioning as described herein.

In one embodiment, the sleeve may be constructed from two polypropylene films wherein at least an lower or outer surface of one of the sheets polypropylene film is provided with a three-dimensional printed pattern. The sheets of polypropylene film having a three dimensional pattern printed thereon employed to produce the sleeve may be connected together or laminated or may be separate layers. In an alternative embodiment, the sleeve may be constructed from only one sheet of polypropylene film having a three dimensional pattern printed thereon.

The sheet of material 10 may vary in color. Further, the sheet of material 10 may comprise other decorative patterns or designs in addition to the three dimensional pattern 28 which are printed, etched, and/or embossed thereon. In addition, the sheet of material 10 may have various colorings, coatings, flocking and/or metallic finishes, applied separately or simultaneously or may be characterized totally or partially by pearlescent, opaque, translucent, transparent, tinted, iridescent or the like, qualities. Each of the above-named characteristics may occur alone or in combination. Moreover, each surface of the sheet of material 10 may vary in the combination of such characteristics.

The sheet of material 10 has a width 30 extending generally between the first side 20 and the second side 22, respectively, sufficiently sized whereby the sheet of material 10 can be wrapped about and encompass a floral grouping or a flower pot. The sheet of material 10 has a length 32 extending generally between the third side 24 and the fourth side 26, respectively, sufficiently sized whereby the sheet of material 10 extends over a substantial portion of the floral grouping when the sheet of material 10 has been wrapped about the floral grouping in accordance with the present invention, as described in detail, herein. The sheet of material 10 may also be wrapped about a flower pot to substantially wrap and cover the flower pot in accordance with the present invention.

A plurality of sheets of material 10 may be connected together to form a roll as is shown in U.S. patent application Ser. No. 08/003,777, filed Jan. 13, 1993, entitled "MATERIAL AND ADHESIVE STRIP DISPENSER", now U.S. Pat. No. 5,459,976 the specification of which is hereby expressly incorporated in its entirety herein by reference.

The ink compositions which can be applied to sheet of material 10 to produce the three dimensional patterns 28 on the sheet of material 10 can be any ink composition, either solvent-based or water-based, which are compatible with the sheet of material 10 and which contain a foaming agent capable of foaming the ink composition on curing to produce the three dimensional patterns 28. Such foamable ink compositions are well known in the printing art. However, for environmental reasons it is preferred that the foamable ink composition be a water-based ink composition. An example of a foamable water-based ink composition which can be employed to produce the three dimensional pattern 28 on the sheet of material 10 is disclosed in U.S. patent application Ser. No. 08/448,950 filed May 24, 1995, entitled "Water-based Ink Composition Free Of Volatile Organic Compounds For Disposition On A Substrate", now U.S. Pat. No. 5,594,048 the specification of which is hereby expressly incorporated in its entirety herein by reference.

The foamable ink compositions may be applied to the sheet of material 10 in any conventional manner. The method of application may be manual or mechanical. If the sheets of material are in the form of a roll, then gravure, flexographic procedures, or Mayer rod procedures may be used to apply the foamable ink composition to the sheet of material 10.

Figure 3:
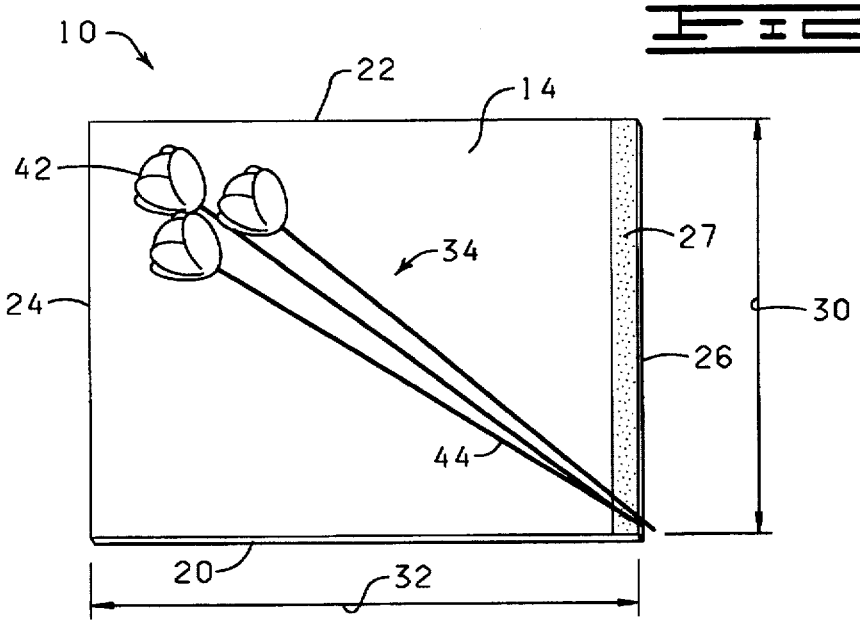
FIG. 3 is a perspective view of a sheet of material having a three-dimensional pattern thereon having a bonding material disposed along one edge thereof and a floral grouping disposed on the sheet of material.
Figure 4:
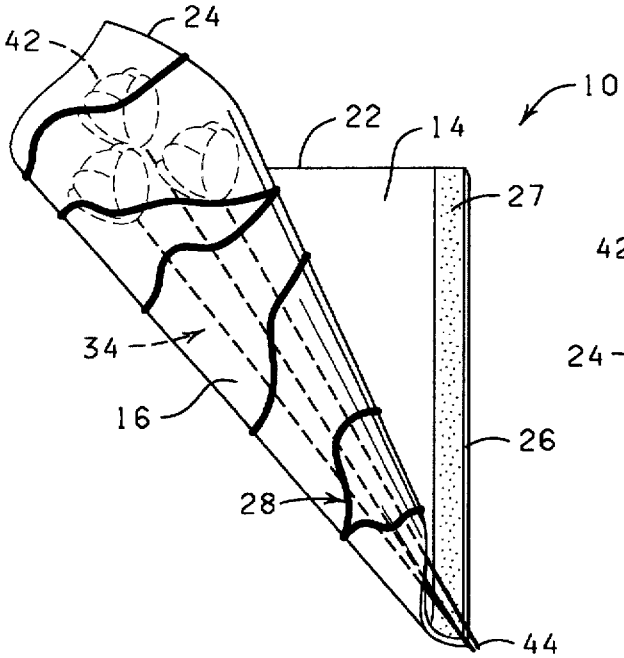
FIG. 4 is a perspective view of the floral grouping of FIG. 3 being wrapped with the sheet of material of having a three-dimensional pattern thereon by one method of wrapping wherein the sheet of material is provided with a bonding material.

FIGS. 3–6 illustrate the use of the sheet of material 10 having a three dimensional pattern 28 printed thereon in wrapping a floral grouping 34 to provide a decorative cover 36 for the floral grouping 34. The sheet of material 12 (which may optionally have the strip of bonding material 27 disposed upon the upper surface 14, the lower surface 16 or both, such as the strip of bonding material 27 disposed along at least a portion of the upper surface 14 so as to be disposed substantially adjacent the fourth side 26 of the sheet of material 10 as shown in FIGS. 3 and 4) is provided, either as an individual sheet or from a pad or roll by any means or other described herein.

The bonding material 27, if present, may have a backing or release strip (not shown). The backing or release strip may be left applied for a period of time to the bonding material 27 after it is disposed on a surface of the sheet of material 10 prior to its use as a wrapping material, to protect the bonding qualities of the bonding strip. In operation, an operator may dispose the sheet of material 10 on a support surface (not shown); the lower surface 16 of the sheet of material 10 contacting the support surface.

Referring more specifically to FIG. 2, the floral grouping 34 is placed upon the upper surface 14 of the sheet of material 10 in a diagonal orientation. The floral grouping 34 has an upper bloom or foliage portion 42 and a lower stem portion 44.

Figure 5:
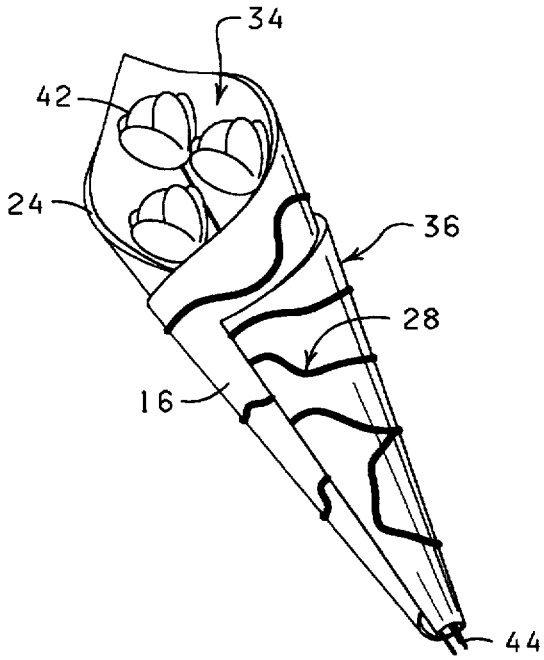
FIG. 5 is a perspective view of a decorative cover for the floral grouping formed from the sheet of material of FIG. 3 wherein the decorative cover formed from the sheet of material has a conical configuration.
Figure 6:
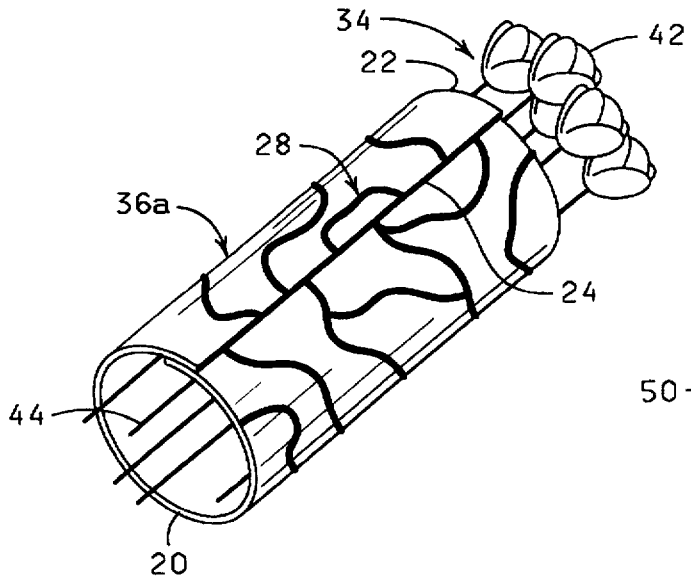
FIG. 6 is a perspective view of a decorative cover formed from a sheet of material having a three dimensional printed pattern thereon disposed wherein the floral grouping is wrapped with the sheet of material by a second method of wrapping so that the decorative cover formed from the sheet of material has a substantially cylindrical configuration.

Referring to FIGS. 3–5, the sheet of material 10 is then wrapped about the floral grouping 34 by the operator, the operator overlapping a portion of the sheet of material 10 over another portion of the sheet of material 10. That is, for example, the operator places the first side 20 of the sheet of material 10 over the floral grouping 34, as shown in FIG. 4. The operator continues to roll the floral grouping 34 and the sheet of material 10 in the direction toward the second side 22 of the sheet of material 10 until the upper surface 14 near second side 22 firmly engages the lower surface 16 of the sheet of material 10, wherein the floral grouping 34 is substantially encompassed by the sheet of material 10, and wherein the bonding material 27 contacts both the sheet of material 10 to provide the decorative cover 36 which substantially encompasses and surrounds a substantial portion of the floral grouping 34. FIG. 6 shows the floral grouping 34 wrapped in a conical fashion with the bloom end 42 exposed near the open upper end of the decorative cover 36 and the stem end 44 exposed near the lower end of the decorative cover 36.

Figure 7:
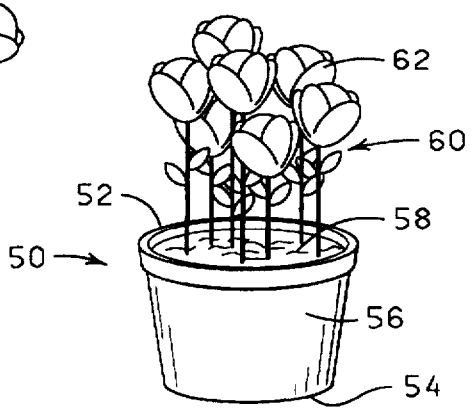
FIG. 7 is a perspective view of a flower pot containing a potted plant.

In another embodiment, illustrated in FIG. 7, the sheet of material 10 is utilized to wrap the floral grouping 34. The floral grouping 34 is disposed upon the sheet of material 10 approximately parallel to side 24 of the sheet of material 10. The sheet of material 10 is wrapped generally about the stem portion 44 of the floral grouping 34 to a position wherein the third side 24 of the sheet of material 10 generally overlaps the fourth side 26 of the sheet of material 10 in a cylindrical fashion. It should be noted that the sheet of material 10 may be wrapped a plurality of times about the stem portion 44 of the floral grouping 34 before the overlapping of the third side 24 and the fourth side 26 of the sheet of material 10. As before, the portion of the sheet of material 10 near the third side 26 is disposed generally adjacent another portion of the sheet of material 10 and the two adjacent portions then are brought into contact where they may be bondingly engaged, thereby securing the sheet of material 10 generally about the floral grouping 34 so as to provide a decorative cover 36*a* for the floral grouping 34.

In another version of the invention the sheet of material 10 may be used to wrap a flower pot or pot-type container, as noted above. Shown in FIG. 7 is a flower pot designated by the reference numeral 50 and which has an open upper end 52, a bottom end 54, an outer peripheral surface 56, an inner retaining space 58 within which may be disposed a growing medium. The flower pot 50 may contain a botanical item, such as a plant 60, which has an upper portion 62 comprising blooms or foliage or both.

Figure 8:
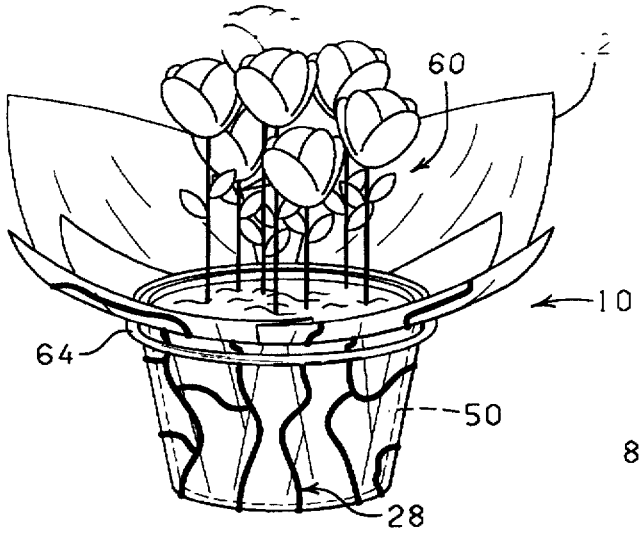
FIG. 8 is perspective view of a decorative cover positioned about the flower pot of FIG. 7 wherein the decorative cover is formed from a sheet of material having a three dimensional printed pattern thereon.

The sheet of material 10 may be wrapped about the flower pot 50 by any one of numerous methods used to wrap sheets of material about flower pots to form decorative pot covers for flower pots, such as a decorative cover 61 disposed about the flower pot 50 illustrated in FIG. 8. The sheet of material 10 may, for example, be formed by hand about the outer peripheral surface 56 of the flower pot 50 to produce the decorative cover 61. The decorative cover 61 can then be secured about the flower pot 50 by a bonding means or material by an elastic band 64 such that the open upper end 52 of the flower pot 50 remains substantially uncovered by the decorative cover 61 substantially as shown in FIG. 8.

Figure 9:
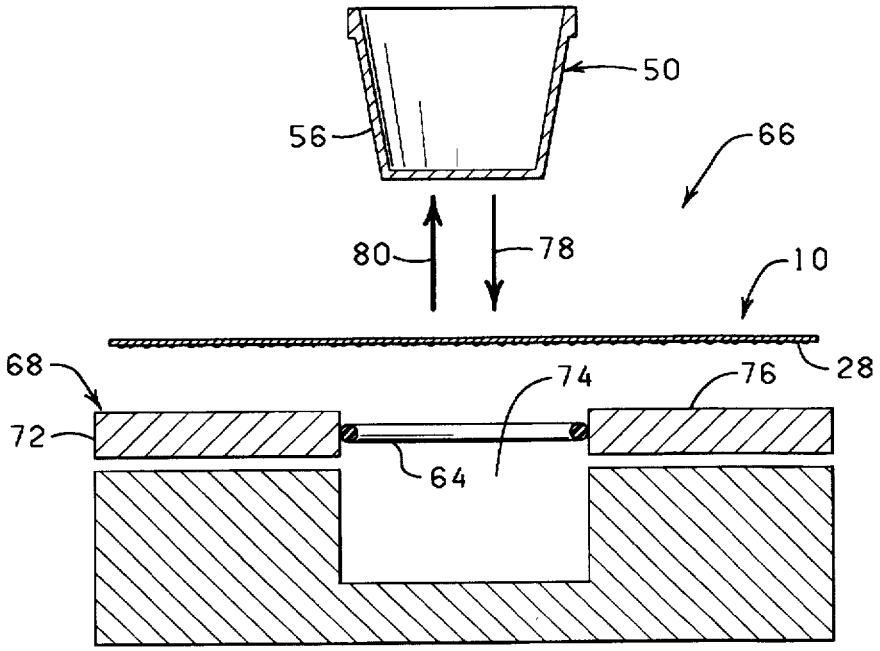
FIG. 9 is a cross-sectional view of a flower pot cover former and band applicator apparatus having the sheet of material of FIG. 2 disposed above an opening of the flower pot cover former and band applicator and having a flower pot disposed above the sheet of material.

Referring now to FIG. 9, a flower pot cover former and band applicator apparatus 66 for forming the sheet of material 10 into the decorative cover 61 for the flower pot 50 is illustrated. The flower pot cover former and band applicator device 66 comprises a band applicator 68 and a flower pot cover former 76. The flower pot cover former and band applicator device 66 has a support platform 72 with an opening 74 formed therein. A band, such as elastic band 64, is disposed circumferentially about the opening 74 in the support platform 72.

The lower surface 16 of the sheet of material 10 is positioned on an upper surface 76 on the support platform 72 such that the sheet of material 10 is positioned over the opening 74 in the support platform 72. The flower pot 50 is positioned above the sheet of material 10 and is moved in a direction 78 into the opening 74 of the flower pot cover former and band applicator device 66. As the flower pot 50 is moved into the opening 74, the sheet of material 10 is pressed about the outer peripheral surface 56 of the flower pot 50 thereby forming the decorative cover 61 about the flower pot 50. The decorative cover 61 is then secured about the flower pot 50 by the elastic band 64. The flower pot 50 having the decorative cover 61 secured thereto is then moved in a direction 80 out of the opening 74 in the support platform 72.

The elastic band 64 could be applied manually or automatically such as by the method shown in U.S. Pat. No. 5,105,599 which is hereby incorporated herein by reference. The band 64 could be applied as a tie using a method such as described in "Single Station Covering and Fastening System", U.S. Ser. No. 08/252,876, now U.S. Pat. No. 5,609,009 the specification of which is hereby incorporated herein by reference. The sheet of material 10 could be applied automatically about the pot 60, for example, by methods shown in U.S. Pat. Nos. 4,733,521 and 5,291,721, both of which are hereby incorporated herein by reference.

In stead of securing the decorative cover 61 about the flower pot 50 via the band 64, the decorative cover 61 formed from the sheet of material 10 may be secured to the flower pot 50 by the use of one or more bonding materials. For example, the upper surface 14 of the sheet of material 10 may have a bonding material disposed upon a portion thereof. When the sheet of material 10 is disposed about the flower pot 50, at least a portion of the upper surface 14 of the sheet of material 10 contacts the outer peripheral surface 56 of the flower pot 50 and is thereby bonded and held about the flower pot 50 via the bonding material.

The bonding material may cover a portion of the upper surface 14 of the sheet of material 10 or the bonding material may entirely cover the upper surface 14 of the sheet of material 10. The bonding material may be disposed on the upper surface 14 of the sheet of material 10 in the form of a strip or in the form of spaced-apart spots. One method for disposing a bonding material on the sheet of material 10 is described in U.S. Pat. No. 5,111,637, entitled "Method For Wrapping A Floral Grouping", issued to Weder, et al. on May 12, 1992, which is expressly incorporated herein by reference.

The term "bonding material" or "bonding means" when used herein can mean an adhesive, frequently a pressure sensitive adhesive, or a cohesive or any adhesive/cohesive combination, having adhesive qualities (i.e., qualities of adhesion or adhesion/cohesion, respectively) sufficient to cause the attachment of a portion of the sheet of material 10 to itself, to a floral grouping, or to a flower pot. Since the bonding material may comprise either an adhesive or an adhesive/cohesive combination, it will be appreciated that both adhesives and cohesives are known in the art, and both are commercially available. When the bonding material is a cohesive, a similar cohesive material must be placed on the adjacent surface for bondingly contacting and bondingly engaging with the cohesive material. The term "bonding material or bonding means" also includes materials which are heat sealable and, in this instance, the adjacent portions of the material must be brought into contact and then heat must be applied to effect the seal. The term "bonding material or bonding means" also includes materials which are sonic sealable and vibratory sealable. The term "bonding material or bonding means" when used herein also means a heat sealing lacquer or hot melt, material which may be applied to the material and, in this instance, heat, sound waves, or vibrations, also must be applied to effect the sealing.

The term "bonding material or bonding means" when used herein also means any type of material or thing which can be used to effect the bonding or connecting of the two adjacent portions of the material or sheet of material to effect the connection or bonding described herein. The term "bonding material or bonding means" may also include ties, labels, bands, ribbons, strings, tapes (including single or double-sided adhesive tapes), staples or combinations thereof. Some of the bonding materials would secure the ends of the material while other bonding material may bind the circumference of a wrapper, or a sleeve, or, alternatively and/or in addition, the bonding materials would secure overlapping folds in the material and/or sleeve. Another way to secure the wrapping and/or sleeve is to heat seal the ends of the material to another portion of the material. One way to do this is to contact the ends with an iron of sufficient heat to heat seal the material.

Alternatively, a cold seal adhesive may be utilized as the bonding material or means. The cold seal adhesive adheres only to a similar substrate, acting similarly as a cohesive, and binds only to itself. The cold seal adhesive, since it bonds only to a similar substrate, does not cause a residue to build up on equipment thereby both permitting much more rapid disposition and use of such equipment to form articles and reducing labor costs Further, since no heat is required to effect the seal, the dwell time, that is, the time for the sheet of material to form and retain the shape of an article, such as a flower pot cover or flower pot, is reduced. A cold seal adhesive binds quickly and easily with minimal pressure, and such a seal is not readily releasable. This characteristic is different from, for example, a pressure sensitive adhesive.

The term "bonding material or bonding means" when used herein also means any heat or chemically shrinkable material, and static electrical or other electrical means, chemical welding means, magnetic means, mechanical or barb-type fastening means or clamps, curl-type characteristics of the film or materials incorporated in material which can cause the material to take on certain shapes, cling films, slots, grooves, shrinkable materials and bands, curl materials, springs, and any type of welding method which may weld portions of the material to itself or to the pot, or to both the material itself and the pot.

Description of FIGS. 10–16

Figure 10:
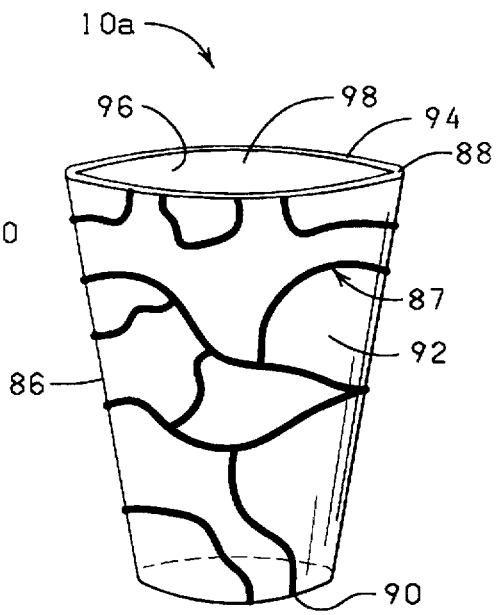
FIG. 10 is a perspective view of a floral sleeve formed from a sheet of material having a three dimensional printed pattern thereon.

Shown in FIG. 10 is a decorative cover designated therein by the general reference numeral 10*a* which comprises a flexible bag or sleeve 86 of unitary construction having a three-dimensional pattern 87 printed thereon in accordance with the present invention. The sleeve 86 may be used as a decorative cover 10*a* for a floral grouping or a flower pot. The sleeve 86 initially comprises a flexible flat collapsed piece of material which is openable in the form of a tube or sleeve. Such sleeves are well known in the floral industry. Further, in accordance with the present invention, the sleeve 86 has a three-dimensional pattern 87, as previously described herein, printed upon at least a portion thereof. The sleeve 86 has an upper end 88, a lower end 90 and an outer peripheral surface 92. The sleeve 86 may be tapered outwardly from the lower end 90 toward a larger diameter at its upper end 88. In its flattened state the sleeve 86 generally has an overall trapezoidal or modified trapezoidal shape, and when opened is substantially frusto-conical to coniform. It will be appreciated, however, that the sleeve 86 may comprise variations on the aforementioned shapes or may comprise significantly altered shapes such as square or rectangular, wherein the sleeve 86 when opened has a cylindrical form, as long as the sleeve 86 functions in accordance with the present invention in the manner described herein. The sleeve 86 (or any other sleeve disclosed herein) may have an angular or contoured shape.

The sleeve 86 has an opening 94 at the upper end 88 and may be open at the lower end 90, or closed with a bottom at the lower end 90. The sleeve 86 also has an inner peripheral surface 96 which, when the sleeve 86 is opened, defines and encompasses an inner retaining space 98. When the lower end 90 of the sleeve 86 has a closed lower end 90, a portion of the lower end 90 may be inwardly folded to form one or more russets (not shown) for allowing the lower portion of the inner retaining space 98 to be expandable, for example, for receiving the circular bottom of a pot or growing medium.

The sleeve 86 is generally frusto-conically shaped, but the sleeve 86 may be, by way of example but not by way of limitation, cylindrical, frusto-conical, a combination of both frusto-conical and cylindrical, or any other shape, as long as the sleeve 86 functions as described herein as noted above. Further, the sleeve 86 may comprise any shape, whether geometric, non-geometric, asymmetrical and/or fanciful as long as it functions in accordance with the present invention. The sleeve 86 may also be equipped with drain holes (if having a closed bottom) or side ventilation holes (not shown), or can be made from gas permeable or impermeable materials.

The material from which the sleeve 86 is constructed is the same as previously described above for the sheet of material 10. Such materials used to construct the sleeve 86 are further described in U.S. Pat. No. 5,111,637, which is expressly incorporated herein by reference. Any thickness of material may be utilized in accordance with the present invention as long as the sleeve 86 may be formed as described herein, and as long as the formed sleeve 86 may contain at least a portion of a flower pot or a floral grouping, as described herein. Additionally, an insulating material such as bubble film, preferable as one of two or more layers, can be utilized in order to provide additional protection for the item, such as the floral grouping, contained therein.

Figure 11:
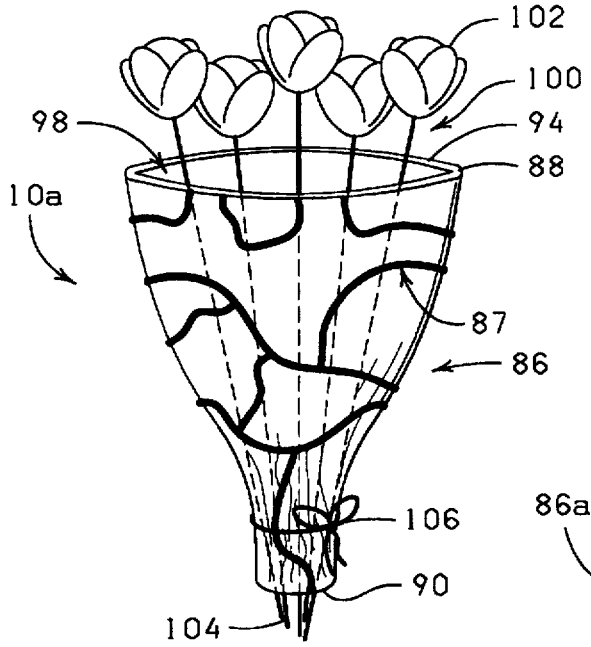
FIG. 11 is a perspective view of the floral sleeve of FIG. 8 disposed about a floral grouping.
Figure 12:
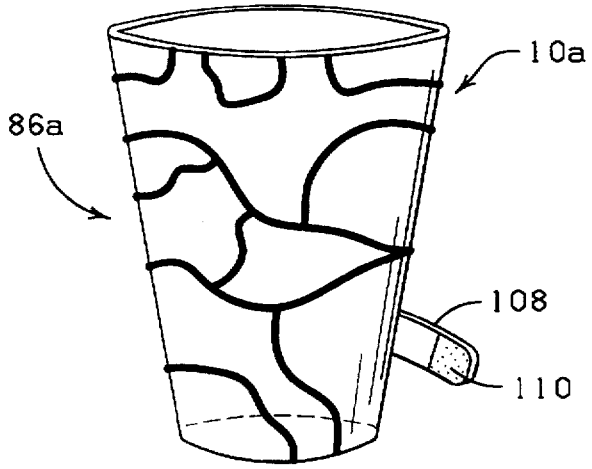
FIG. 12 is a perspective view of a floral sleeve having a cinching member wherein the floral sleeve is formed from a sheet of material having a three dimensional printed pattern thereon.
Figure 13:
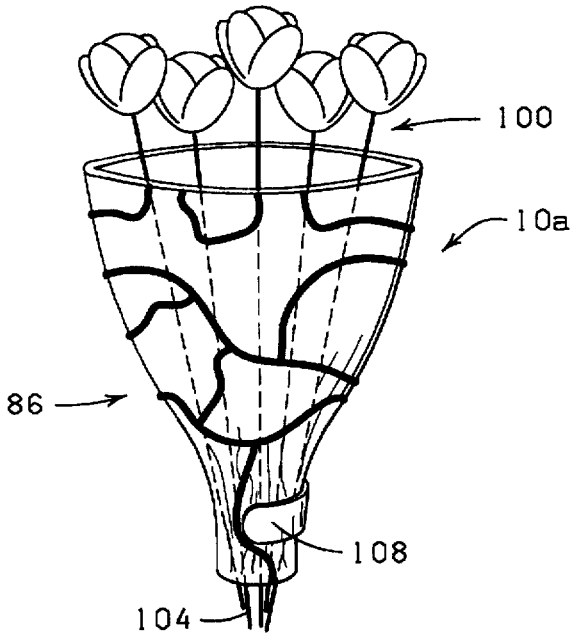
FIG. 13 is a perspective view of the floral sleeve of FIG. 10 disposed about a floral grouping.

In FIG. 11 the sleeve 86 is illustrated having a three-dimensional pattern 87 printed on the outer peripheral surface 92 of the sleeve 86. A floral grouping 100 is disposed within the inner retaining space 98 of the sleeve 86. Generally, an upper or bloom portion 102 of the floral grouping 100 is exposed near the opening 94 of the sleeve 86 and a lower or stem portion 104 of the floral grouping 100 is exposed near the lower end 90 of the sleeve 86. Either end of the sleeve 86 may be closed about the floral grouping 100. Generally, a portion of the sleeve 86 is tightened about a portion of the stem portion 104 of the floral grouping 100 for holding the decorative cover 10*a* about the floral grouping 100. For example, the sleeve 86 may be held by a tie 106 tied about the sleeve 86 such as is shown in FIG. 11. Other means for binding the sleeve 866 may be employed such as the bonding means and materials described elsewhere herein. For example, as shown in FIG. 12, sleeve 86*a* having a three-dimensional pattern 87*a* printed thereon is provided with a cinching tab 108 having a bonding material 110 disposed upon a surface thereof. The cinching tab 108 can be used to gather portions of the sleeve 86*a* together about the stem portion 104 of the floral grouping 100 as shown in FIG. 13 for holding the sleeve 86*a* tightly about the floral grouping 100.

Similarly, it may generally be desired to use the sleeve 86 as a decorative cover for a flower pot (not shown). The flower pot will generally contain a botanical item or plant. The flower pot can be deposited into the open sleeve 86 in a manner well known in the art, such as manually wherein the sleeve 86 is opened by hand and the flower pot deposited therein.

As noted above, a bonding material may be disposed on a portion of the sleeve 86 or any sleeve described herein to assist in holding the sleeve 86 to the flower pot when the flower pot is disposed within the sleeve 86 or to assist in closing the upper end 88 of the sleeve 86 or adhering the sleeve 86 to the flower pot after the flower pot has been disposed therein, as will be discussed in further detail below.

It will be understood that the bonding material, if present, may be disposed as a strip or block on a surface of the sleeve 86. The bonding material may also be disposed upon either the outer peripheral surface 92 or the inner peripheral surface 96 of the sleeve 86, as well as upon the flower pot. Further, the bonding material may be disposed as spots of bonding material, or in any other geometric, non-geometric, asymmetric, or fanciful form, and in any pattern including covering either the entire inner peripheral surface 96 and/or outer peripheral surface 92 of the sleeve 86 and/or the flower pot. The bonding material may be covered by a cover or release strip which can be removed prior to the use of the sleeve 86 or flower pot. The bonding material can be applied by means known to those of ordinary skill in their art. One method for disposing a bonding material, in this case an adhesive is described in U.S. Pat. No. 5,111,637, which is hereby incorporated herein by reference.

As noted above, a bonding material may be disposed on at least a portion of .the inner peripheral surface 96 of the sleeve 86 (or any other sleeve described herein), or, alternatively, the bonding material may be disposed on the outer peripheral surface 92 of a flower pot contained within the sleeve 86, while the sleeve 86 may be free of the bonding material. In a further alternative, the bonding material may be disposed both on at least a portion of the flower pot as well as upon at least a portion of the inner peripheral surface 96 of the sleeve 86. In addition, a portion of the bonding material may also be disposed on the outer peripheral surface 92 of the sleeve 86 as well. It will be understood that the bonding material may be disposed in a solid section of bonding material. The bonding material, when present, is disposed on the sleeve 86 and/or flower pot by any means known in the art.

Certain versions of sleeves described herein may be used in combination with a preformed pot cover. For example, a preformed pot cover may be applied to the pot, then the covered pot wrapped or disposed within a sleeve. Either the cover or the sleeve, or both, may have the three-dimensional pattern printed thereon. Examples of sleeves which may be used in this invention are shown in the specification of U.S. Ser. No. 08/237,078 now U.S. Pat. No. 5,625,979 which is expressly incorporated herein by reference in its entirety. Equipment and devices for forming sleeves are commercially available, and well known in the art.

Figure 14:
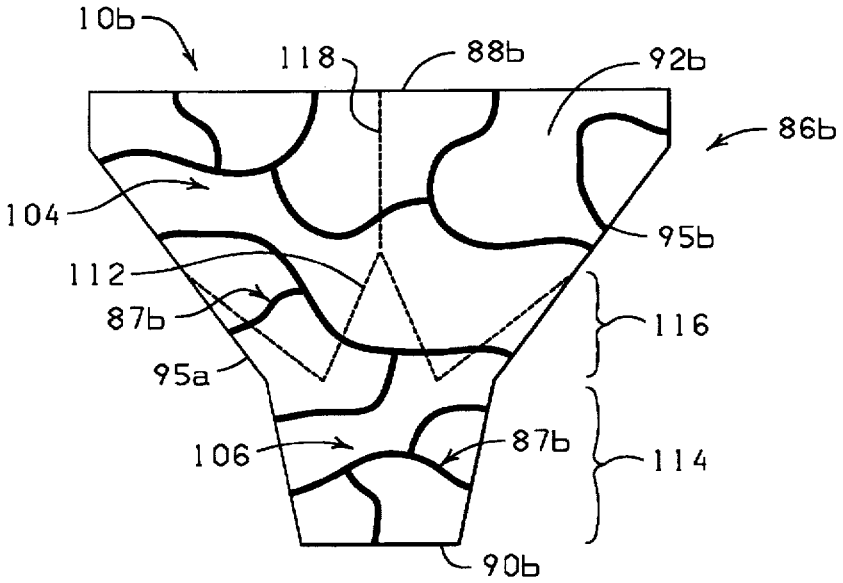
FIG. 14 is a side view of a sleeve having a detachable portion wherein the sleeve is formed from a sheet of material having a three dimensional printed pattern thereon.
Figure 15:
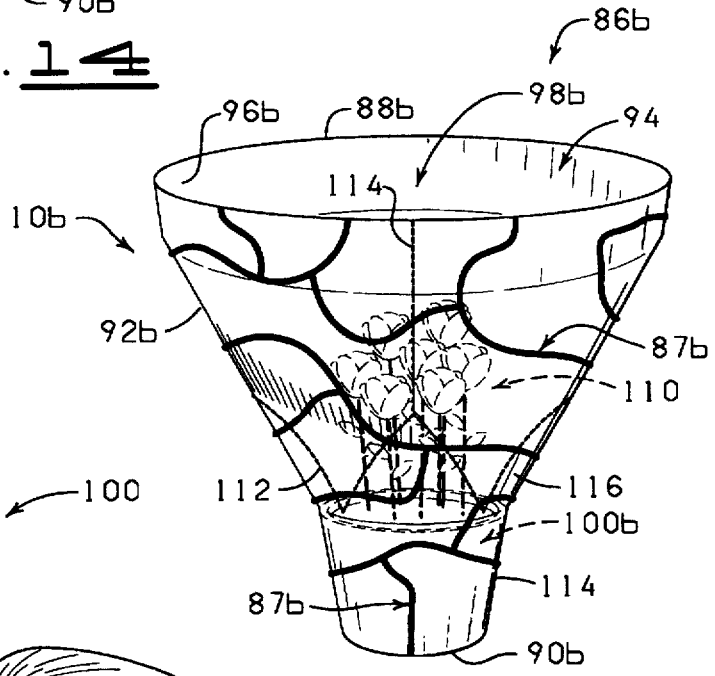
FIG. 15 is a perspective view of the sleeve of FIG. 14 having a flower pot disposed therein.

Shown in FIGS. 14 and 15 is another embodiment of a decorative cover **10*b* comprising a sleeve constructed in accordance With the present invention and designated by the general reference numeral 86*b*. The sleeve 86*b* has a three-dimensional printed pattern 87*b* printed thereon; and the sleeve 86*b* has a "detaching" element in predetermined areas for detaching a portion of the sleeve 86*b*. The sleeve 86*b* generally initially comprises a flexible flat collapsed piece of material which is openable in the form of a tube or sleeve. The sleeve 86*b*** is constructed of the same material and in the same way as described previously herein and may be described exactly the same as the other sleeves described herein except for the additional elements described herein.

The sleeve **86*b* has an upper end 88*b*, a lower end 90*b*, and an outer peripheral surface 92*b*. The sleeve 86*b* has an opening 94*b* at the upper end 88*b* thereof, and the sleeve 86*b* may be open at the lower end 90 or closed with a bottom at the lower end 90. In a flattened state, the sleeve 86*b* has a first side 95*a* and a second side 95*b*. The sleeve 86*b* also has an inner peripheral surface 96*b* which, when the sleeve 86*b* is opened, defines and encompasses an inner retaining space 98*b* as shown in FIG. 15. When the lower end 90*b* of the sleeve 86*b* has a closed bottom, a portion of the lower end 90*b* may be inwardly folded to form one or more gussets (not shown) for permitting a circular bottom of an object such as a potted plant 100*b* to be disposed in the inner retaining space 98*b* of the lower end 90*b* of the sleeve 86*b***.

As shown in FIGS. 14 and 15, the sleeve **86*b* is demarcated into an upper portion 104 and a lower portion 106. The lower portion 106 of the sleeve 86*b* is generally sized to contain the flower pot 100*b*. The upper portion 104 of the sleeve 86*b* is sized to substantially surround and encompass a plant 110 contained in the flower pot 100*b* disposed within the lower portion 106 of the sleeve 86*b*. The sleeve 86*b* is demarcated into the upper portion 104 and the lower portion 106 by a detaching element 112 for enabling the detachment of the upper portion 104 of the sleeve 86*b* from the lower portion 106 of the sleeve 86*b*. In the present version, the detaching element 112 is a plurality of generally laterally-oriented or alternatingly diagonally-oriented perforations which extend circumferentially across the outer peripheral surface 92*b* of the sleeve 86*b* from the first side 95*a* to the second side 95*b***.

In a preferred embodiment, as shown in FIGS. 14 and 15, the lower portion 106 of the sleeve **86*b* further comprises a base portion 114 and a skirt portion 116. The base portion 114 comprises that part of the lower portion 106 which, when the flower pot 100*b* is placed into the lower portion 106, has an inner peripheral surface which is substantially adjacent to and surrounds the outer peripheral surface of the flower pot 100*b*. The skirt portion 116 comprises that part of the lower portion 106 which extends beyond an open upper end of the flower pot 100*b* and adjacent at least a portion of the plant 110 contained within the flower pot 100*b* and which is left to freely extend at an angle, inwardly or outwardly, from the base portion 114 when the upper portion of 104 the sleeve 86*b* is detached from the lower portion 106 of the sleeve 86*b* by actuation of the detaching element 112**.

In the intact sleeve **86*b*, the skirt portion 116 comprises an upper peripheral edge congruent with the detaching element 112 which is connected to a lower peripheral edge, also congruent with the detaching element 112, of the upper portion 104 of the sleeve 86*b*. In FIGS. 14 and 15, the upper peripheral edge of the skirt portion 116 is congruent with a series of alternatingly diagonally-oriented lines of perforations which together form a zig-zag and comprise the detaching element 112. The upper portion 104 of the sleeve 86*b* may also have an additional detaching element 118 indicated as a plurality of vertical perforations for facilitating removal of the upper portion 104 and which are disposed more or less vertically therein extending between the detaching element 112 of the sleeve 86*b***.

The upper portion 104 of the sleeve **86*b* is thereby separable from the lower portion 106 of the sleeve 86*b* by tearing the upper portion 104 along both the vertical perforations 118 and the detaching element 112, thereby separating the upper portion 104 from the lower portion 106 of the sleeve 86*b*. The lower portion 106 of the sleeve 86*b* remains disposed as the base portion 114 about the flower pot 100*b* and as the skirt portion 116 about the plant 110 forming a decorative cover 120 as shown in FIG. 16 which substantially surrounds and encompasses the flower pot 100*b* and the plant 110 contained therein the three-dimensional pattern 87*b* may be printed upon only the lower portion 106 of the sleeve 86*b*, for example, the base and skirt portions 114 and 116 while the upper portion 104 is left unprinted or is printed with another design. When the upper portion 104** is detached, the portion printed with the three-dimensional pattern is left.

"Detaching element" or "detaching means" as used herein, means any element, or combination of elements, or features, such as, but not by way of limitation, perforations, tear strips, zippers, and any other devices or elements of this nature known in the art, or any combination thereof. Therefore, while perforations are shown and described in detail herein, it will be understood that tear strips, zippers, or any other "detaching elements" known in the art, or any combination thereof, could be substituted therefor and/or used therewith.

In a general method of use of sleeves 86–86b as a decorative cover for a flower pot, an operator provides a sleeve 86–86b, and the flower pot 100b having a plant 110 disposed in a growing medium contained within the flower pot 100b. The operator then disposes the flower pot 100b having the plant 110 contained therein into the sleeve by opening the sleeve at its first end and assuring both that the opening therein is in an open condition, and that the inner peripheral surface of the sleeve is somewhat expanded outward as well, as shown in FIG. 15. The operator then manually or automatically disposes the flower pot 100b into the opening in the sleeve, the flower pot 100b being disposed generally through the upper portion of the sleeve into generally the lower portion of the sleeve, the flower pot 100b remaining in the lower portion of the sleeve, permitting the sleeve to substantially surround and tightly encompass the pot. It will be understood that alternatively, the sleeve with an extension (not shown), may be utilized, the sleeve being disposed on rods, or wickets and the flower pot then being disposed in the sleeve either before or after the sleeve has been removed from the wickets.

Embodiments of FIGS. 17–18

Referring now to FIGS. 17 and 18, a decorative preformed flower pot cover 122 is illustrated constructed from a sheet of material 123 having a three-dimensional printed pattern 124. The sheet of material 123 used in the construction of the preformed flower pot cover 122 is identical to the sheet of material 10 having the three dimensional printed pattern 28 thereon hereinbefore described.

The decorative preformed pot cover 122 has an upper end 125, a lower end 126, and an outer peripheral surface 128. An opening 130 intersects the upper end 125, forming an inner peripheral surface 132 which defines and encompasses a retaining space within which a flower pot 134 containing a floral grouping 136 may be disposed in a manner well known in the art and which is shown in FIG. 18.

Figure 19:
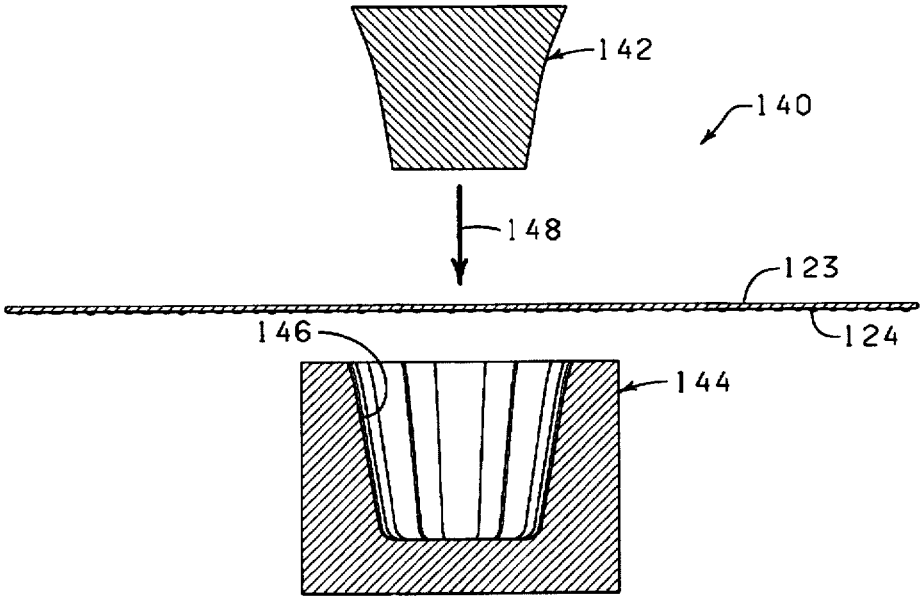
FIG. 19 is a diagrammatic, cross-sectional view of a male and female mold having a sheet of material disposed therebetween for forming the preformed pot cover of FIG. 18.

The decorative preformed flower pot cover 122 may be constructed of a singly sheet of material 123 having the three-dimensional pattern 124 printed thereon substantially as shown in FIG. 19 or a plurality of layers of the same and/or different types of material may be employed in the formation of the decorative preformed flower pot cover 122. The thickness of the sheet of material 123 may vary widely and any thickness of the sheet of material 123 may be utilized in accordance with the present invention so longs as the sheet of material 123 is formable into the decorative preformed flower pot cover 122 as described herein. When the sheet of material 123 is constructed of a plurality of layers of material, each layer of material may be connected to an adjacent layer of material via a bonding material.

The decorative preformed flower pot cover 122 may be formed using a conventional mold system 140 comprising a male mold 142 and a female mold 144 having a mold cavity 146 for matingly receiving the male mold 142. The sheet of material 123 having the three-dimensional pattern 124 printed thereon is positioned between the male and female molds 142 and 144, respectively. Movement of the male mold 142 in the direction 148 and into the mold cavity 146 forces the sheet of material 122 to be disposed about the portion of the male mold 142 disposed in the mold cavity 146 of the female mold 146 and thereby forms the sheet of .material 123 into the preformed decorative flower pot cover 122 (FIG. 18)

Methods for forming such preformed decorative pot covers are well known in the art. Two methods of forming such covers are described in U.S. Pat. Nos. 4,773,182 and 5,291,721, each of which is expressly incorporated herein by reference.

Further, in accordance with the present invention, the preformed flower pot cover 122 is Constructed from the same materials described herein above, may have a bonding means or material disposed upon a portion thereof, and has printed upon at least a portion thereof the three-dimensional printed pattern described in detail above.

Changes may be made in the construction and the operation of the various components, elements and assemblies described herein or in the steps or the sequence of steps of the methods described herein without departing from the spirit and scope of the invention as defined in the following claims.

What is claimed is:

1. A method for providing a decorative cover about a floral grouping, comprising:

providing a sheet of material having a three-dimensional printed pattern thereon;

providing a floral grouping having a bloom end and a stem end; and wrapping the sheet of material having the three-dimensional pattern printed thereon about the floral grouping to provide the decorative cover for the floral grouping.

2. The method of claim 1 wherein, in the step of providing the sheet of material having a three-dimensional printed pattern thereon, the sheet of material is further defined as having a thickness of from about 0.1 mil to about 30 mils.

3. The method of claim 1 wherein, in the step of providing the sheet of material having a three-dimensional printed pattern thereon, the sheet of material is further defined as having a thickness of from about 0.5 mil to about 2.5 mils.

4. The method of claim 1 wherein, in the step of providing the sheet of material having a three-dimensional printed pattern thereon, the sheet of material is further defined as being constructed from a material selected from the group consisting of treated or untreated paper, cellophane, metal foil, polymer film, non-polymer film, cardboard, fiber, cloth, burlap, and laminations or combinations thereof.

5. The method of claim 1 wherein, in the step of providing the sheet of material having a three-dimensional printed pattern thereon, the sheet of material is further characterized as having bonding means disposed on at least a portion thereof for bondingly holding the decorative cover produced from the sheet of material having the three-dimensional printed pattern thereon about the floral grouping.

6. The method of claim 1 wherein, in the step of providing the sheet of material having a three-dimensional printed pattern thereon, the sheet of material is further defined as having a portion which is selectively detachable therefrom.

7. A method for packaging a floral grouping comprising the steps of:

providing a sheet of material having an upper surface, a lower surface and a three-dimensional printed pattern on at least the lower surface;

providing a floral grouping having an upper end consisting of a flower portion and a lower end consisting of a stem portion;

placing the floral grouping on the upper surface of sheet of material having the three-dimensional printed pattern on at least the lower surface thereof; and wrapping the sheet of material having the three-dimensional printed pattern on at least the lower surface thereof about the floral grouping so that the sheet of material having the three-dimensional printed pattern thereon substantially encompasses and surrounds a substantial portion of the floral grouping.

8. A method for packaging an item, comprising the steps of:

providing a sheet of material having a first side and a second side, a first end and a second end, an upper surface and a lower surface, the sheet of material having a three-dimensional printed pattern thereon;

providing a floral grouping having an upper end consisting of a flower portion and a lower end consisting of a stem portion having a stem end, the floral grouping comprising the item;

placing the floral grouping on the sheet of material having the three-dimensional printed pattern thereon;

wrapping the sheet of material having the three-dimensional printed pattern thereon about the floral grouping with the first side of the sheet of material overlapping portions of the sheet of material so that the sheet of material having the three-dimensional printed pattern thereon substantially encompasses and surrounds a substantial portion of the stem portion of the floral grouping, the sheet of material having the three-dimensional printed pattern thereon wrapped about the floral grouping forming a conically shaped decorative cover having an opening extending through a lower end thereof and an opening extending through the upper end thereof with the stem end of the floral grouping extending through the opening in the lower end of the decorative cover and the flower end of the floral grouping being exposed near the opening in the upper end of the decorative cover.

9. A method for packaging an item comprising the steps of:

providing a sheet of material having a first side and a second side, a first end and a second end, an upper surface and a lower surface, the sheet of material having a three-dimensional printed pattern thereon;

providing a floral grouping having a flower portion and a stem portion, the stem portion having a lower stem end, the floral grouping comprising the item;

placing the floral grouping on the sheet of material having the three-dimensional printed pattern thereon;

wrapping the sheet of material having the three-dimensional printed pattern thereon about the floral grouping with the first side of the sheet of material overlapping portions of the sheet of material so that the sheet of material having the three-dimensional printed pattern thereon substantially encompasses and surrounds a substantial portion of the flower end of the floral grouping and a substantial portion of the stem portion of the floral grouping, the sheet of material having the three-dimensional printed pattern thereon being tightly wrapped about the stem portion of the floral grouping, the sheet of material having the three-dimensional printed pattern thereon wrapped about the floral grouping forming a conically shaped decorative cover having an opening extending through a lower end thereof and an opening extending through the upper end thereof with the lower stem end of the stem portion of the floral grouping extending through the opening in the lower end of the decorative cover and the flower end of the floral grouping being exposed near the opening in the upper end of the decorative cover, the upper end of the decorative cover being loosely wrapped about the flower end of the floral grouping.

10. The method of claim 9 wherein, in the step of providing the sheet of material having a three-dimensional printed pattern thereon, the sheet of material is defined further as having a thickness in a range from about 0.1 mil to about 30 mils.

11. The method of claim 9 wherein, in the step of providing the sheet of material having a three-dimensional printed pattern thereon, the sheet of material is defined further as having a thickness in a range from about 0.5 mil to about 2.5 mils.

12. A method for packaging an item comprising the steps of:

providing a sheet of material having a first end and a second end, an upper surface and a lower surface, the sheet of material having a three-dimensional printed pattern thereon;

providing a floral grouping having an upper end consisting of a flower end and a lower end consisting of a stem portion, the floral grouping comprising the item; placing the floral grouping on the sheet of material;

wrapping the sheet of material having the three-dimensional printed pattern thereon about the floral grouping with a portion of the sheet of material overlapping other portions of the sheet of material so that the sheet of material substantially encompasses and surrounds a substantial portion of the flower end and a substantial portion of the stem portion of the floral grouping, the sheet of material being tightly wrapped about the stem portion of the floral grouping and the sheet of material being loosely wrapped about the floral grouping so as to form a conically shaped decorative cover having an opening extending through a lower end thereof and an opening extending through the upper end thereof with a portion of the stem portion of the floral grouping extending through the opening in the lower end of the conical shaped decorative cover and the flower end of the floral grouping being exposed near the opening in the upper end of the conical shaped decorative cover.

13. The method of claim 12 wherein, in the step of providing the sheet of material having a three-dimensional printed pattern thereon, the sheet of material having a three-dimensional printed pattern thereon is defined further as having a thickness in a range from about 0.1 mil to about 30 mils.

14. The method of claim 12 wherein, in the step of providing the sheet of material having a three-dimensional printed pattern thereon, the sheet of material having a three-dimensional printed pattern thereon is defined further as providing the sheet of material having a thickness in a range from about 0.5 mil to about 2.5 mils.

15. A method for packaging an item comprising:

providing a sheet of material having a first end, a second end, an upper surface and a lower surface, the sheet of material having a three-dimensional printed pattern thereon;

providing a floral grouping having a flower end and a stem end, the floral grouping comprising the item; and wrapping the sheet of material having the three-dimensional printed pattern thereon about the floral grouping with a portion of the sheet of material overlapping other portions of the sheet of material generally between the first and the second ends of the sheet of material and with the sheet of material substantially encompassing and surrounding a substantial portion of the stem end of the floral grouping, the sheet of material wrapped about the floral grouping forming a decorative cover having an opening extending through an upper end thereof and the flower end of the floral grouping being exposed near the opening in the upper end thereof.

16. The method of claim 15 wherein, in the step of providing the sheet of material having a three-dimensional printed pattern thereon, the sheet of material having the three-dimensional printed pattern thereon is defined further as having a thickness in a range from about 0.1 mil to about 30 mils.

17. The method of claim 15 wherein, in the step of providing the sheet of material having a three-dimensional printed pattern thereon, the sheet of material having the three-dimensional printed pattern thereon is defined further as having a thickness in a range from about 0.5 mil to about 2.5 mils.

18. The method of claim 15 wherein, in the step of providing the sheet of material having a three-dimensional printed pattern thereon, the sheet of material having the three-dimensional printed pattern thereon is defined further to include the steps of:

providing a roll of material, the roll of material having a three-dimensional printed pattern thereon;

unrolling material from the roll of material until a predetermined amount of material having a three-dimensional printed pattern thereon has been unrolled from the roll of material; and cutting the unrolled material from the roll of material to provide the sheet of material having the three-dimensional printed pattern thereon.

19. A method for packaging an item comprising the steps of:

providing a sheet of material having a first end and a second end, an upper surface and a lower surface, the sheet of material having a three-dimensional printed pattern thereon;

providing a floral grouping having a stem end and a flower end, the floral grouping comprising the item; and wrapping the sheet of material having the three-dimensional printed pattern thereon about the floral grouping with a portion of the sheet of material overlapping other portions of the sheet of material whereby there are no loose flaps formed by the sheet of material, and with the sheet of material substantially encompassing and surrounding a substantial portion of the flower end of the floral grouping and a substantial portion of the stem end of the floral grouping, the sheet of material being tightly wrapped about the stem end of the floral grouping, the sheet of material having the three-dimensional printed pattern thereon wrapped about the floral grouping forming a decorative cover having an opening extending through an upper end thereof with the flower end of the floral grouping being exposed near the opening in the upper end of the decorative cover, the upper end of the decorative cover being loosely wrapped about the flower end of the floral grouping.

20. The method of claim 19 wherein, in the step of providing the sheet of material having a three-dimensional printed pattern thereon, the sheet of material having the three-dimensional printed pattern thereon is defined further as having a thickness in a range of from about 0.1 mil to about 30 mils.

21. The method of claim 19 wherein, in the step of providing the sheet of material having a three-dimensional printed pattern thereon, the sheet of material having the three-dimensional printed pattern thereon is defined further as having a thickness in a range of from about 0.5 mil to about 2.5 mils.

22. The method of claim 19 wherein the step of providing the sheet of material having a three-dimensional printed pattern thereon is defined further to comprise the steps of:

providing a roll of the material having a three-dimensional printed pattern thereon;

unrolling material from the roll of material until a predetermined amount of material having a three-dimensional printed pattern thereon has been unrolled from the roll of material; and cutting the unrolled material from the roll of material to provide the sheet of material having the three-dimensional printed pattern thereon.

23. A method for packaging an item comprising the steps of:

providing a sheet of material having a first end and a second end, an upper surface and a lower surface, the sheet of material having a three-dimensional printed pattern thereon;

providing a floral grouping having a flower end and a stem end, the floral grouping comprising the item; and wrapping the sheet of material having the three-dimensional pattern printed thereon about the floral grouping with a portion of the sheet of material overlapping other portions of the sheet of material so that the sheet of material substantially encompasses and surrounds a substantial portion of the flower end of the floral grouping and a substantial portion of the stem end of the floral grouping, the sheet of material having the three-dimensional printed pattern thereon wrapped about the floral grouping forming a decorative cover having an opening extending through an upper end thereof with the flower end of the floral grouping being exposed near the opening in the upper end of the decorative cover, the upper end of the wrapping being loosely wrapped about the flower end of the floral grouping.

24. The method of claim 23 wherein, in the step of providing the sheet of material having a three-dimensional printed pattern thereon, the sheet of material having the three-dimensional printed pattern thereon is defined further as having a thickness in a range of from about 0.1 mil to about 30 mils.

25. The method of claim 23 wherein, in the step of providing the sheet of material having a three-dimensional printed pattern thereon, the sheet of material having the three-dimensional printed pattern thereon is defined further as having a thickness in range of from about 0.5 mil to about 2.5 mils.

26. The method of claim 23 wherein the step of providing the sheet of material having a three-dimensional printed pattern thereon is defined further to include the steps of:

providing a roll of the material having a three-dimensional printed pattern thereon;

unrolling material from the roll of material until a predetermined amount of material having a three-dimensional printed pattern thereon has been unrolled from the roll of material; and cutting the unrolled material from the roll of material to provide the sheet of material having the three-dimensional printed pattern thereon.

27. A method for packaging an item comprising;

providing a sheet of material having a first end and a second end, an upper surface and a lower surface, the sheet of material having a three-dimensional printed pattern thereon;

providing a floral grouping having a flower end and a stem end, the floral grouping comprising the item; and wrapping the sheet of material having the three-dimensional printed pattern thereon about the floral grouping with a portion of the sheet of material overlapping other portions of the sheet of material such that the overlapping portions of the sheet of material extend generally between the first and the second ends of the sheet of material and the sheet of material substantially encompasses and surrounds a substantial portion of the stem end of the floral grouping.

28. A method for packaging an item comprising the steps of:

providing a sheet of material having a first end and a second end, an upper surface and a lower surface, the sheet of material having a three-dimensional printed pattern thereon;

providing a floral grouping having a stem end and a flower end, the floral grouping comprising the item;

placing a floral grouping on the sheet of material having the three-dimensional printed pattern thereon; and wrapping the sheet of material having the three-dimensional printed pattern thereon about the floral grouping so that the sheet of material substantially encompasses and surrounds a substantial portion of the flower end of the floral grouping and a substantial portion of the stem end of the floral grouping, the sheet of material being tightly wrapped about the stem end of the floral grouping, the sheet of material having the three-dimensional printed pattern thereon wrapped about the floral grouping forming a conically shaped decorative cover having an opening extending through an upper end thereof with the flower end of the floral grouping being exposed near the opening in the upper end thereof, the upper end of the decorative cover being loosely wrapped about the flower end of the floral grouping.

29. The method of claim 28 wherein, in the step of providing the sheet of material having a three-dimensional printed pattern thereon, the sheet of material having the three-dimensional printed pattern thereon is defined further as having a thickness in a range of from about 0.1 mil to about 30 mils.

30. The method of claim 28 wherein, in the step of providing the sheet of material having a three-dimensional printed pattern thereon, the sheet of material having the three-dimensional printed pattern thereon is defined further as having a thickness in a range of from about 0.5 mil to about 2.5 mils.

31. The method of claim 28 wherein the step of providing the sheet of material having a three-dimensional printed pattern thereon is defined further to comprise the steps of:

providing a roll of the material having a three-dimensional printed pattern thereon;

unrolling material from the roll of material until a predetermined amount of material having a three-dimensional printed pattern thereon has been unrolled from the roll of material; and cutting the unrolled material from the roll of material to provide the sheet of material having the three-dimensional printed pattern thereon.

32. A method for packaging an item comprising the steps of:

providing a sheet of material having a first end and a second end, an upper surface and a lower surface, the sheet of material having a three-dimensional printed pattern thereon;

providing a floral grouping having a flower end and a stem end, the floral grouping comprising the item;

placing the floral grouping on the sheet of material having the three-dimensional printed pattern thereon; and wrapping the sheet of material having the three-dimensional printed pattern thereon about the floral grouping with a portion of the sheet of material overlapping other portions of the sheet of material so that the sheet of material substantially encompasses and surrounds a substantial portion of the flower end of the floral grouping and a substantial portion of the stem end of the floral grouping, the sheet of material having the three-dimensional printed pattern thereon wrapped about the floral grouping forming a conically shaped decorative cover having an opening extending through an upper end thereof with the flower end of the floral grouping being exposed near the opening in the upper end of the decorative cover, the upper end of the decorative cover being loosely wrapped about the flower end of the floral grouping.

33. The method of claim 32 wherein, in the step of providing the sheet of material having a three-dimensional printed pattern thereon, the sheet of material having the three-dimensional printed pattern thereon is defined further as having a thickness in a range of from about 0.1 mil to about 30 mils.

34. The method of claim 32 wherein in the step of providing the sheet of material having a three-dimensional printed pattern thereon, the sheet of material having the three-dimensional printed pattern thereon is defined further as having a thickness in range of from about 0.5 mil to about 2.5 mils.

35. The method of claim 32 wherein the step of providing the sheet of material having a three-dimensional printed pattern thereon is defined further to include the steps of:

providing a roll of the material having a three-dimensional printed pattern thereon;

unrolling material from the roll of material until a predetermined amount of material having the three-dimensional printed pattern thereon has been unrolled from the roll of material; and cutting the unrolled material from the roll of material to provide the sheet of material having the three dimensional printed pattern thereon.

36. A method for providing a cover for a floral grouping having an upper end portion and a lower end portion, comprising the steps of:

providing a sheet of material having a first side, an opposed second side, an upper surface, a lower surface and a sheet extension extending from the first side of the sheet of material, the sheet of material having a three-dimensional pattern printed on at least a portion of at least one of the upper and lower surfaces thereof;

providing the floral grouping having an upper end portion and a lower end portion;

wrapping the sheet of material having a three-dimensional pattern printed thereon about the lower end portion of the floral grouping such that portions of the sheet of material overlap and substantially encompass the lower end portion of the floral grouping and thereby provide a cover extending about the lower end portion of the floral grouping having a three-dimensional printed pattern; and wrapping the sheet extension about the upper end portion of the floral grouping such that portions of the sheet extension overlap and substantially encompass the upper end portion of the floral grouping and thereby substantially cover the upper end portion of the floral grouping.

37. The method of claim 36 wherein, in the step of providing the sheet of material having a three-dimensional printed pattern thereon, the sheet of material is further provided with a line of perforations disposed between the first side of the sheet of material and the sheet extension, and wherein the method further comprises the step of:

removing the sheet extension from the sheet of material having the three-dimensional printed pattern thereon by tearing the sheet extension generally along the line of perforations for exposing the upper end portion of the floral grouping previously encompassed by the sheet extension.

38. The method of claim 37 wherein, in the step of providing the sheet of material having a three-dimensional printed pattern thereon, the sheet of material is defined further as being foldable and bendable whereby the sheet of material can be formed by hand about the lower end portion of the floral grouping.

39. The method of claim 38 wherein, in the step of providing the sheet of material having a three-dimensional printed pattern thereon, the sheet of material is defined further as having a thickness in a range of from about 0.1 mil to about 30 mils.

40. A method for providing a decorative cover about a floral grouping, comprising:

providing a sheet of material having a three-dimensional pattern wherein the three-dimensional pattern is produced by application of an ink composition to the sheet of material such that upon curing of the ink composition the three-dimensional pattern is provided on the sheet of material;

providing a floral grouping having a bloom end and a stem end; and wrapping the sheet of material having the three-dimensional pattern about the floral grouping to provide the decorative cover for the floral grouping.

41. The method of claim 40 wherein, in the step of providing the sheet of material having a three-dimensional pattern, the sheet of material is further defined as having a thickness of from about 0.1 mil to about 30 mils.

42. The method of claim 40 wherein, in the step of providing the sheet of material having a three-dimensional pattern, the sheet of material is further defined as having a thickness of from about 0.5 mil to about 2.5 mils.

43. The method of claim 40 wherein, in the step of providing the sheet of material having a three-dimensional pattern, the sheet of material is further defined as constructed from a material selected from the group consisting of treated or untreated paper, cellophane, metal foil, polymer film, non-polymer film, cardboard, fiber, cloth, burlap, and laminations or combinations thereof.

44. The method of claim 40 wherein, in the step of providing the sheet of material having a three-dimensional pattern thereon, the sheet of material is further characterized as having bonding means disposed on at least a portion thereof for bondingly holding the decorative cover produced from the sheet of material having a three-dimensional pattern about the floral grouping.

45. The method of claim 40 wherein, in the step of providing the sheet of material having a three-dimensional pattern, the sheet of material is further defined as having a portion which is selectively detachable therefrom.

46. A method for packaging a floral grouping comprising the steps of:

providing a sheet of material having an upper surface, a lower surface and a three-dimensional pattern on at least the lower surface, the three-dimensional pattern being produced by application of an ink composition to the sheet of material such that upon curing of the ink composition the three-dimensional pattern is provided on the sheet of material;

providing a floral grouping having an upper end consisting of a flower end and a lower end consisting of a stem portion;

placing the floral grouping on the upper surface of sheet of material having the three-dimensional pattern on at least the lower surface thereof; and wrapping the sheet of material having the three-dimensional pattern on at least the lower surface thereof about the floral grouping so that the sheet of material having the three-dimensional pattern on at least the lower surface thereof substantially encompasses and surrounds a substantial portion of the floral grouping.

47. A method for packaging an item, comprising the steps of:

providing a sheet of material having a first side and a second side, a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having an upper end consisting of a flower end and a lower end consisting of a stem portion having a stem end, the floral grouping comprising the item;

placing the floral grouping on the sheet of material having the three-dimensional printed pattern thereon;

wrapping the sheet of material having the three-dimensional pattern thereon about the floral grouping with the first side of the sheet of material overlapping portions of the sheet of material so that the sheet of material having the three-dimensional pattern thereon substantially encompasses and surrounds a substantial portion of the stem portion of the floral grouping, the sheet of material having the three-dimensional pattern thereon wrapped about the floral grouping forming a conically shaped decorative cover having an opening extending through a lower end thereof and an opening extending through the upper end thereof with the stem end of the floral grouping extending through the opening in the lower end of the decorative cover and the flower end of the floral grouping being exposed near the opening in the upper end of the decorative cover.

48. A method for packaging an item comprising the steps of:

providing a sheet of material having a first side and a second side, a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having an flower end and a stem portion, the stem portion having a lower stem end, the floral grouping comprising the item;

placing the floral grouping on the sheet of material having the three-dimensional pattern thereon;

wrapping the sheet of material having the three-dimensional printed pattern thereon about the floral grouping with the first side of the sheet of material overlapping portions of the sheet of material so that the sheet of material having the three-dimensional pattern thereon substantially encompasses and surrounds a substantial portion of the flower end of the floral grouping and a substantial portion of the stem portion of the floral grouping, the sheet of material having the three-dimensional pattern thereon being tightly wrapped about the stem portion of the floral grouping, the sheet of material having the three-dimensional pattern thereon wrapped about the floral grouping forming a conically shaped decorative cover having an opening extending through a lower end thereof and an opening extending through the upper end thereof with the lower stem end of the stem portion of the floral grouping extending through the opening in the lower end of the decorative cover and the flower end of the floral grouping being exposed near the opening in the upper end of the decorative cover, the upper end of the decorative cover being loosely wrapped about the flower end of the floral grouping.

49. The method of claim 48 wherein, in the step of providing the sheet of material having a three-dimensional pattern thereon, the sheet of material is defined further as having a thickness in a range of from about 0.1 mil to about 30 mils.

50. The method of claim 48 wherein, in the step of providing the sheet of material having a three-dimensional pattern thereon, the sheet of material is defined further as having a thickness in a range from about 0.5 mil to about 2.5 mils.

51. A method for packaging an item comprising the steps of:

providing a sheet of material having a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having an upper end consisting of a flower end and a lower end consisting of a stem portion, the floral grouping comprising the item; placing the floral grouping on the sheet of material;

wrapping the sheet of material having the three-dimensional pattern thereon about the floral grouping with a portion of the sheet of material overlapping other portions of the sheet of material so that the sheet of material substantially encompasses and surrounds a substantial portion of the flower end and a substantial portion of the stem portion of the floral grouping, the sheet of material being tightly wrapped about the stem portion of the floral grouping and the sheet of material being loosely wrapped about the floral grouping so as to form a conically shaped decorative cover having an opening extending through a lower end thereof and an opening extending through the upper end thereof with a portion of the stem portion of the floral grouping extending through the opening in the lower end of the conical shaped decorative cover and the flower end of the floral grouping being exposed near the opening in the upper end of the conical shaped decorative cover.

52. The method of claim 51 wherein, in the step of providing the sheet of material having a three-dimensional pattern thereon, the sheet of material having a three-dimensional pattern thereon is defined further as having a thickness in a range of from about 0.1 mil to about 30 mils.

53. The method of claim 51 wherein, in the step of providing the sheet of material having a three-dimensional pattern thereon, the sheet of material having a three-dimensional pattern thereon is defined further as having a thickness in a range of from about 0.5 mil to about 2.5 mils.

54. A method for packaging an item comprising:

providing a sheet of material having a first end, a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a flower end and a stem end, the floral grouping comprising the item; and wrapping the sheet of material having the three-dimensional pattern thereon about the floral grouping with a portion of the sheet of material overlapping other portions of the sheet of material generally between the first and the second ends of the sheet of material and with the sheet of material substantially encompassing and surrounding a substantial portion of the stem end of the floral grouping, the sheet of material wrapped about the floral grouping forming a decorative cover having an opening extending through an upper end thereof and the flower end of the floral grouping being exposed near the opening in the upper end thereof.

55. The method of claim 54 wherein, in the step of providing the sheet of material having a three-dimensional pattern thereon, the sheet of material having the three-dimensional pattern thereon is defined further as having a thickness in a range of from about 0.1 mil to about 30 mils.

56. The method of claim 54 wherein, in the step of providing the sheet of material having a three-dimensional pattern thereon, the sheet of material having the three-dimensional pattern thereon is defined further as having a thickness in a range of from about 0.5 mil to about 2.5 mils.

57. The method of claim 54 wherein, in the step of providing the sheet of material having a three-dimensional pattern thereon, the sheet of material having the three-dimensional pattern thereon is defined further to include the steps of:

providing a roll of material, the roll of material having a three-dimensional pattern thereon wherein the three-dimensional pattern is produced by application of an ink composition to the roll of material such that upon curing of the ink composition the three-dimensional pattern is provided on the roll of material;

unrolling material from the roll of material until a predetermined amount of material having a three-dimensional pattern thereon has been unrolled from the roll of material; and cutting the unrolled material from the roll of material to provide the sheet of material having the three-dimensional pattern thereon.

58. A method for packaging an item comprising the steps of:

providing a sheet of material having a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a stem end and a flower end, the floral grouping comprising the item; and wrapping the sheet of material having the three-dimensional pattern thereon about the floral grouping with a portion of the sheet of material overlapping other portions of the sheet of material whereby there are no loose flaps formed by the sheet of material, and with the sheet of material substantially encompassing and surrounding a substantial portion of the flower end of the floral grouping and a substantial portion of the stem end of the floral grouping, the sheet of material being tightly wrapped about the stem end of the floral grouping, the sheet of material having the three-dimensional pattern thereon wrapped about the floral grouping forming a decorative cover having an opening extending through an upper end thereof with the flower end of the floral grouping being exposed near the opening in the upper end of the decorative cover, the upper end of the decorative cover being loosely wrapped about the flower end of the floral grouping.

59. The method of claim 58 wherein, in the step of providing the sheet of material having a three-dimensional pattern thereon, the sheet of material having the three-dimensional pattern thereon is defined further as having a thickness in a range of from about 0.1 mil to about 30 mils.

60. The method of claim 58 wherein, in the step of providing the sheet of material having a three-dimensional pattern thereon, the sheet of material having the three-dimensional pattern thereon is defined further as having a thickness in a range of from about 0.5 mil to about 2.5 mils.

61. The method of claim 58 wherein the step of providing the sheet of material having a three-dimensional pattern thereon is defined further to comprise the steps of:

providing a roll of the material having a three-dimensional pattern thereon wherein the three-dimensional pattern is produced by application of an ink composition to the roll of material such that upon curing of the ink composition the three-dimensional pattern is provided on the roll of material;

unrolling material from the roll of material until a predetermined amount of material having a three-dimensional pattern thereon has been unrolled from the roll of material; and cutting the unrolled material from the roll of material to provide the sheet of material having the three-dimensional pattern thereon.

62. A method for packaging an item comprising the steps of:

providing a sheet of material having a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a flower end and a stem end, the floral grouping comprising the item; and wrapping the sheet of material having the three-dimensional pattern thereon about the floral grouping with a portion of the sheet of material overlapping other portions of the sheet of material so that the sheet of material substantially encompasses and surrounds a substantial portion of the flower end of the floral grouping and a substantial portion of the stem end of the floral grouping, the sheet of material having the three-dimensional pattern thereon wrapped about the floral grouping forming a decorative cover having an opening extending through an upper end thereof with the flower end of the floral grouping being exposed near the opening in the upper end of the decorative cover, the upper end of the wrapping being loosely wrapped about the flower end of the floral grouping.

63. The method of claim 62 wherein, in the step of providing the sheet of material having a three-dimensional pattern thereon, the sheet of material having the three-dimensional pattern thereon is defined further as having a thickness in a range of from about 0.1 mil to about 30 mils.

64. The method of claim 62 wherein, in the step of providing the sheet of material having a three-dimensional pattern thereon, the sheet of material having the three-dimensional pattern thereon is defined further as having a thickness in a range of from about 0.5 mil to about 2.5 mils.

65. The method of claim 62 wherein the step of providing the sheet of material having a three-dimensional pattern thereon is defined further to include the steps of:

providing a roll of the material having a three-dimensional pattern thereon wherein the three-dimensional pattern is produced by application of an ink composition to the roll of material such that upon curing of the ink composition the three-dimensional pattern is provided on the roll of material;

unrolling material from the roll of material until a predetermined amount of material having a three-dimensional pattern thereon has been unrolled from the roll of material; and cutting the unrolled material from the roll of material to provide the sheet of material having the three-dimensional pattern thereon.

66. A method for packaging an item comprising;

providing a sheet of material having a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a flower end and a stem end, the floral grouping comprising the item; and wrapping the sheet of material having the three-dimensional pattern thereon about the floral grouping with a portion of the sheet of material overlapping other portions of the sheet of material such that the overlapping portions of the sheet of material extend generally between the first and the second ends of the sheet of material and the sheet of material substantially encompasses and surrounds a substantial portion of the stem end of the floral grouping.

67. A method for packaging an item comprising the steps of:

providing a sheet of material having a first end and a second end, an upper surface and a lower surface, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a stem end and a flower end, the floral grouping comprising the item;

placing a floral grouping on the sheet of material having the three-dimensional pattern thereon; and wrapping the sheet of material having the three-dimensional pattern thereon about the floral grouping so that the sheet of material substantially encompasses and surrounds a substantial portion of the flower end of the floral grouping and a substantial portion of the stem end of the floral grouping, the sheet of material being tightly wrapped about the stem end of the floral grouping, the sheet of material having the three-dimensional pattern thereon wrapped about the floral grouping forming a conically shaped decorative cover having an opening extending through an upper end thereof with the flower end of the floral grouping being exposed near the opening in the upper end thereof, the upper end of the decorative cover being loosely wrapped about the flower end of the floral grouping.

68. The method of claim 67 wherein, in the step of providing the sheet of material having a three-dimensional printed pattern thereon, the sheet of material having the three-dimensional printed pattern thereon is defined further as providing the sheet of material having a thickness in a range of from about 0.1 mil to about 30 mils.

69. The method of claim 67 wherein, in the step of providing the sheet of material having a three-dimensional pattern thereon, the sheet of material having the three-dimensional pattern thereon is defined further as having a thickness in a range of from about 0.5 mil to about 2.5 mils.

70. The method of claim 67 wherein, in the step of providing the sheet of material having a three-dimensional pattern thereon is defined further to comprise the steps of:

providing a roll of the material having a three-dimensional printed pattern thereon wherein the three-dimensional pattern is produced by application of an ink composition to the roll of material such that upon curing of the ink composition the three-dimensional pattern is provided on the roll of material;

unrolling material from the roll of material until a predetermined amount of material having a three-dimensional pattern thereon has been unrolled from the roll of material; and cutting the unrolled material from the roll of material to provide the sheet of material having the three-dimensional pattern thereon.

71. A method for packaging an item comprising the steps of:

providing a sheet of material having a first end and a second end, an upper surface and a lower surface, the sheet of material, the sheet of material having a three-dimensional pattern thereon wherein the three-dimensional pattern is produced by application of an ink composition to the sheet of material such that upon curing of the ink composition the three-dimensional pattern is provided on the sheet of material;

providing a floral grouping having a flower end and a stem end, the floral grouping comprising the item;

placing the floral grouping on the sheet of material having the three-dimensional pattern thereon; and wrapping the sheet of material having the three-dimensional pattern thereon about the floral grouping with a portion of the sheet of material overlapping other portions of the sheet of material so that the sheet of material substantially encompasses and surrounds a substantial portion of the flower end of the floral grouping and a substantial portion of the stem end of the floral grouping, the sheet of material having the three-dimensional pattern thereon wrapped about the floral grouping forming a conically shaped decorative cover having an opening extending through an upper end thereof with the flower end of the floral grouping being exposed near the opening in the upper end of the decorative cover, the upper end of the decorative cover being loosely wrapped about the flower end of the floral grouping.

72. The method of claim 71 wherein, in the step of providing the sheet of material having a three-dimensional pattern thereon, the sheet of material having the three-dimensional pattern thereon is defined further as providing the sheet of material having a thickness in a range of from about 0.1 mil to about 30 mils.

73. The method of claim 71 wherein, in the step of providing the sheet of material having a three-dimensional pattern thereon, the sheet of material having the three-dimensional pattern thereon is defined further as having a thickness in a range of from about 0.5 mil to about 2.5 mils.

74. The method of claim 71 wherein the step of providing the sheet of material having a three-dimensional pattern thereon is defined further to include the steps of:

providing a roll of the material having a three-dimensional pattern thereon wherein the three-dimensional pattern is produced by application of an ink composition to the roll of material such that upon curing of the ink composition the three-dimensional pattern is provided on the roll of material;

unrolling material from the roll of material until a predetermined amount of material having the three-dimensional pattern thereon has been unrolled from the roll of material; and cutting the unrolled material from the roll of material to provide the sheet of material having the three dimensional pattern thereon.

* * * * *

UNITED STATES PATENT AND TRADEMARK OFFICE

CERTIFICATE OF CORRECTION

| | | | |
|---|---|---|---|
| PATENT NO. | : | **5,720,155** | Page 1 of 12 |
| DATED | : | **February 24, 1998** | |
| INVENTOR(S) | : | **Donald E. WEDER** | |

It is certified that error appears in the above-identified patent and that said Letters Patent is hereby corrected as shown below:

In the Drawings:

Fig. 6, please add the numeral --26-- and its associated lead line.

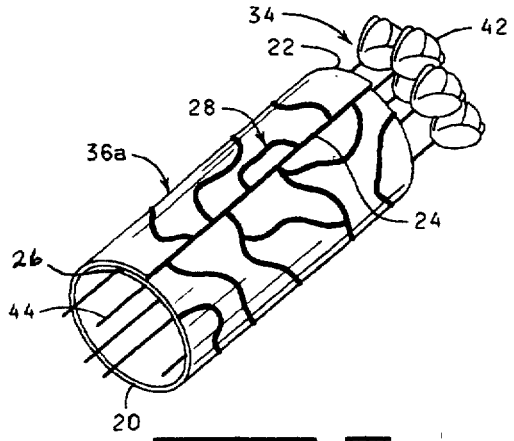

FIG. 6

Fig. 8, please delete the numeral "12" and its associated lead line; please add the numerals --52--; --56--; and --61-- and each associated lead line.

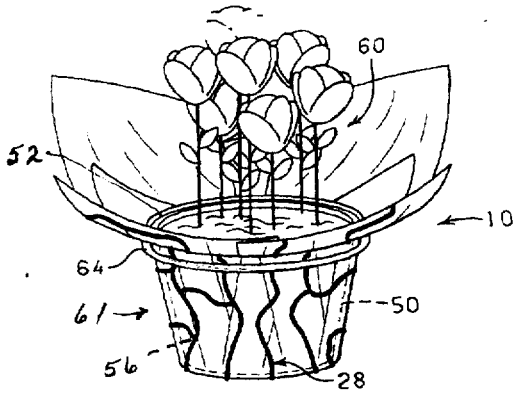

FIG. 8

UNITED STATES PATENT AND TRADEMARK OFFICE

CERTIFICATE OF CORRECTION

| | | | |
|---|---|---|---|
| PATENT NO. | : | **5,720,155** | Page 2 of 12 |
| DATED | : | **February 24, 1998** | |
| INVENTOR(S) | : | **Donald E. WEDER** | |

It is certified that error appears in the above-identified patent and that said Letters Patent is hereby corrected as shown below:

Fig. 9, please add the numeral --16-- and its associated lead line.

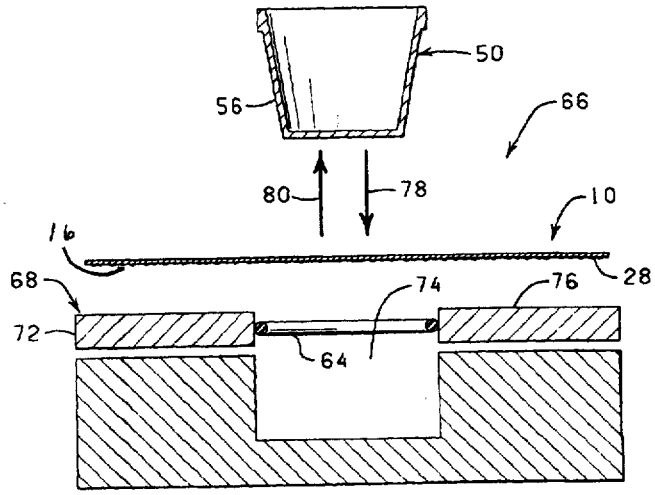

FIG. 9

Fig. 11, please add the numeral --92-- and its associated lead line.

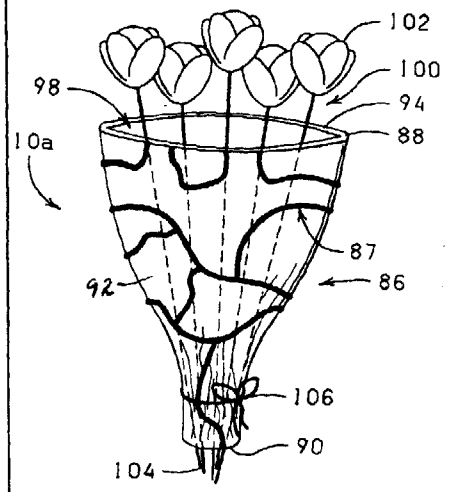

FIG. 11

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Fig. 12, please add the numeral --87a-- and its associated lead line.

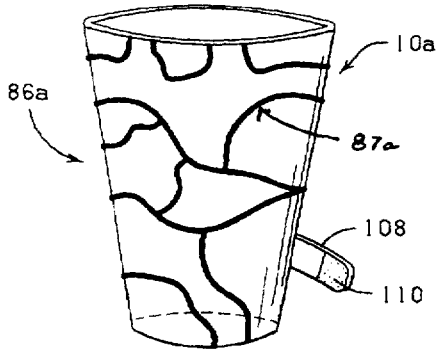

FIG. 12

Fig. 13, please delete the numeral "86" and substitute therefor the numeral --86a--.

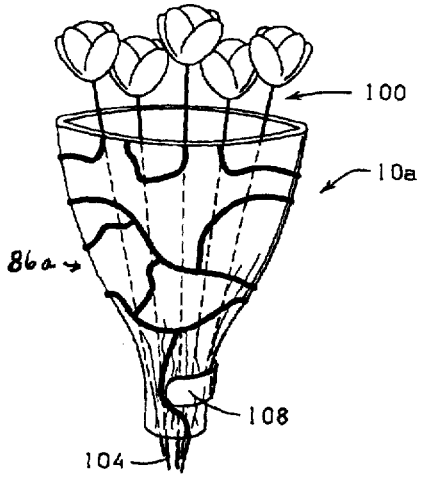

FIG. 13

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Fig. 15, please delete the numeral "94" and substitute therefor --94b--; please add the numeral --106-- and its associated lead line; please add the numeral --104-- and its associated lead line; and please delete the numeral "114" designating the vertical detaching element and substitute therefor --118--.

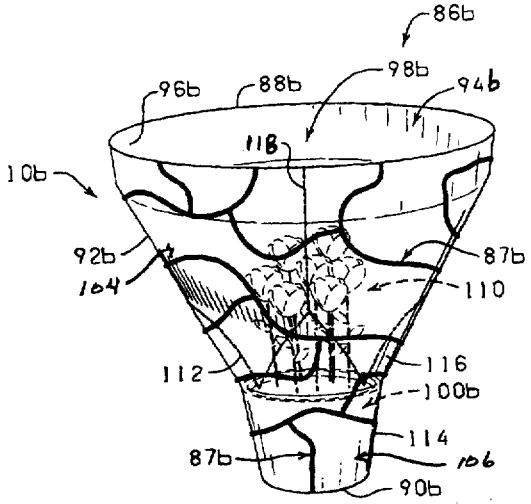

FIG. 15

Fig. 16, please delete the numeral "100" and substitute --110-- therefor; please add the numerals --100b-- and --87b-- and each associated lead line; and please delete the numeral "118" and substitute therefor --120--.

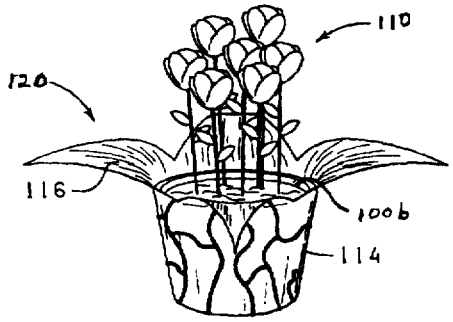

FIG. 16

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Fig. 17, please add the numeral --123-- and its associated lead line.

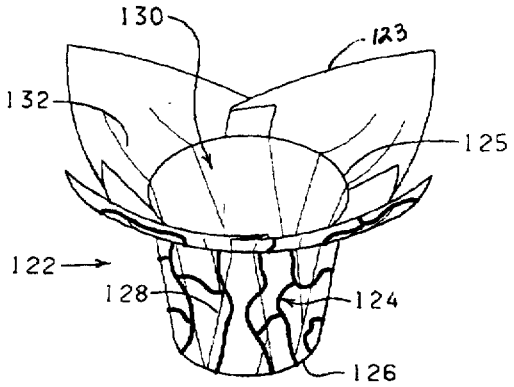

FIG. 17

Fig. 18, please add the numeral --123-- and its associated lead line.

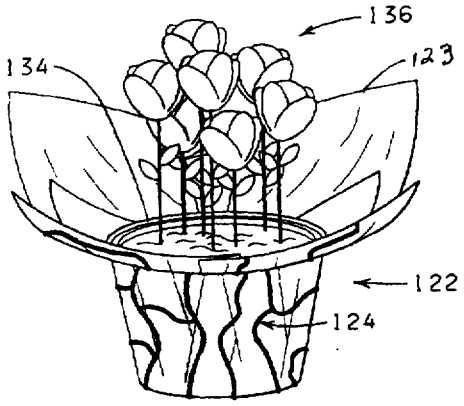

FIG. 18

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

In the Description:

Col. 1: line 30, delete "having a floral grouping disposed thereon";

lines 31-32, delete "having a three-dimensional pattern thereon";

line 36, after "material" and before "having" delete "of";

line 53, after "is" and before "perspective" insert --a--;

lines 66-67, delete "FIG. 8" and substitute --FIG. 10-- therefor;

Col. 2: lines 5-6, delete "FIG. 10" and substitute --FIG. 12-- therefor;

line 15, delete "skirt" and substitute --skirt.-- therefor;

line 18, delete "thereon" and substitute --thereon.-- therefor;

line 24, delete "FIG. 18." and substitute --FIG. 17.-- therefor;

line 49, delete "surface 34" and substitute --surface 14-- therefor;

line 55, delete "FIGS. 1 and 3-6." and substitute --FIGS. 1 and 4-6.-- therefor;

line 57, delete "decorative cover 29" and substitute therefor --decorative cover 36--;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 3: line 28, delete "mad/or" and substitute --and/or-- therefor;

Col. 4: line 10, delete "12" and substitute therefor --10--;

line 14, delete "12" and substitute therefor --10--;

line 23, after 'sheet" and before "except" insert --of material 10--;

line 25, delete "12" and substitute --10-- therefor;

line 27, delete "12" and substitute --10-- therefor;

line 30, after "sheets" and before "may" insert --of material--;

Col. 5: line 9, delete "the sleeve" and substitute therefor --a sleeve--;

line 10, delete "an" and substitute --a-- therefor ;

line 11, after "sheets" and before "polypropylene" insert --of--;

line 52, after "to" and before "sheet" insert --the--;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 6: line 6, after "material" and before "are" insert --10--;

line 13, delete "12" and substitute --10-- therefor;

lines 20-21, delete "or other";

line 27, delete "bonding strip." and substitute --bonding material 27.-- therefor;

line 31, delete "FIG. 2," and substitute therefor --FIG. 3,--;

line 48, delete "both";

line 51, delete "FIG. 6" and substitute therefor --FIG. 5--;

line 56, delete "FIG. 7," and substitute therefor --FIG. 6,--;

line 59, after "to" and before "side" insert --third--;

Col. 7: line 3, delete "side 26" and substitute therefor --side 24--;

line 27, delete "material" and substitute --material; or-- therefor;

line 34, delete "device 66" and substitute --apparatus 66-- therefor;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 7 (cont'd): line 34, delete "68";

line 35, delete "76." and substitute therefor --68.--;

line 36, delete "device 66" and substitute --apparatus 66-- therefor;

line 46, delete "device" and substitute --apparatus-- therefor;

line 63, delete "pot 60." and substitute --pot 50.-- therefor;

line 66, delete "In stead" and substitute --Instead-- therefor;

Col. 8: line 42, delete "melt," and substitute --melt-- therefor;

Col. 9: line 3, delete "costs" and substitute --costs.-- therefor;

Col. 10: line 33, delete "866" and substitute therefor --86--;

Col. 11: line 40, after "element" and before "in" insert --112--;

line 51, delete "90" and substitute therefor --**90*b***--;

line 52, delete "90." and substitute therefor --**90*b***.--;

line 60, delete "**100*b*" and substitute therefor --110*b***--;

Col. 12: line 51, delete "therein the" and substitute --therein. The-- therefor;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 13: line 6, after "sleeve" and before "by" insert --**86-86*b***--;

line 7, delete "sleeve at its first end" and substitute therefor --sleeve **86-86*b* at its upper end 88*b***--;

line 9, after "surface" insert --**96*b***--;

line 9, after "sleeve" insert --**86-86*b***--;

line 12, delete "sleeve," and substitute therefor --sleeve **86-86*b***,-- therefor;

line 13, after "portion" and before "of" insert --104--; after "sleeve" and before "into" insert --**86-86*b***--;

line 14, after "portion" and before "of" insert --106--;

line 14, delete "sleeve," and substitute therefor --sleeve **86-86*b***,--;

line 15, after "portion" and before "of" insert --106--;

line 15, delete "sleeve," and substitute therefor --sleeve **86-86*b***,--;

line 16, after "sleeve" insert --**86-86*b***--;

line 17, delete "pot." and substitute therefor --flower pot **100*b***.--;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 13 (cont'd): line 17, after "sleeve" and before "with" insert --**86-86*b***--;

line 18, after "sleeve" insert --**86-86*b***-- ;

line 19, after "pot" and before "then" insert --**100*b***--;

line 20, after "sleeve" (both occurrences) insert --**86-86*b***--;

line 22, delete "FIGS. 17-18" and substitute --FIGS. 17-19-- therefor;

line 39, delete "singly" and substitute therefor --single--;

line 46, delete "longs" and substitute therefor --long--;

line 60, delete "material 122" and substitute --material 123-- therefor;

line 62, delete "mold 146" and substitute --mold 144-- therefor;

Col. 14: line 62, after "of" and before "sheet" insert --the--;

Col. 17: lines 20-21 (lines 3-4 of claim 18), delete "sheet of material having the three-dimensional printed pattern thereon" and substitute therefor --method--;

Col. 18: line 51 (line 5 of claim 25), after "in" and before "range" insert --a--;

Col. 20: line 33 (line 5 of claim 34), after "in" and before "range" insert --a--;

UNITED STATES PATENT AND TRADEMARK OFFICE

CERTIFICATE OF CORRECTION

PATENT NO. : 5,720,155

DATED : February 24, 1998

INVENTOR(S) : Donald E. WEDER

It is certified that error appears in the above-identified patent and that said Letters Patent is hereby corrected as shown below:

Col. 22: line 11 (line 13 of claim 46), after "of" and before "sheet" insert --the--;

Col. 24: lines 47-48 (lines 3-4 of claim 57), delete "sheet of material having the three-dimensional pattern thereon" and substitute therefor --method--;

Col. 27: line 33 (line 1 of claim 70), delete "wherein, in" and substitute --wherein-- therefor;

lines 54-55 (lines 4-5 of claim 71), delete "the sheet of material,".

Signed and Sealed this

Thirteenth Day of March, 2001

*Attest:*

Nicholas P. Godici

NICHOLAS P. GODICI

*Attesting Officer*

*Acting Director of the United States Patent and Trademark Office*